US011462392B2

(12) United States Patent
Inoue et al.

(10) Patent No.: US 11,462,392 B2
(45) Date of Patent: Oct. 4, 2022

(54) PLASMA PROCESSING APPARATUS

(71) Applicant: Canon Anelva Corporation, Kawasaki (JP)

(72) Inventors: Tadashi Inoue, Sagamihara (JP); Masaharu Tanabe, Fuchu (JP); Kazunari Sekiya, Tokyo (JP); Hiroshi Sasamoto, Tachikawa (JP); Tatsunori Sato, Tokyo (JP); Nobuaki Tsuchiya, Hamura (JP)

(73) Assignee: CANON ANELVA CORPORATION, Kawasaki (JP)

( * ) Notice: Subject to any disclaimer, the term of this patent is extended or adjusted under 35 U.S.C. 154(b) by 0 days.

(21) Appl. No.: 16/720,262

(22) Filed: Dec. 19, 2019

(65) Prior Publication Data

US 2020/0126768 A1 Apr. 23, 2020

Related U.S. Application Data

(63) Continuation of application No. PCT/JP2017/023611, filed on Jun. 27, 2017.

(51) Int. Cl.
*H01J 37/32* (2006.01)
*H01J 37/18* (2006.01)

(52) U.S. Cl.
CPC ..... *H01J 37/32541* (2013.01); *H01J 37/18* (2013.01); *H01J 37/3255* (2013.01);
(Continued)

(58) Field of Classification Search
None
See application file for complete search history.

(56) References Cited

U.S. PATENT DOCUMENTS 4,014,779 A 3/1977 Kuehnle
4,025,339 A 5/1977 Kuehnle
(Continued)

FOREIGN PATENT DOCUMENTS

CN 1155748 A 7/1997
CN 2907173 Y 5/2007
(Continued)

OTHER PUBLICATIONS

Supplemental European Search Report issued in corresponding European Patent Application No. 18823378.7, dated May 25, 2020 (7 pages).
(Continued)

*Primary Examiner* — Srinivas Sathiraju
(74) *Attorney, Agent, or Firm* — Buchanan Ingersoll & Rooney PC

(57) ABSTRACT

A plasma processing apparatus includes a balun having a first unbalanced terminal, a second unbalanced terminal, a first balanced terminal, and a second balanced terminal, a grounded vacuum container, a first electrode electrically connected to the first balanced terminal, and a second electrode electrically connected to the second balanced terminal. When Rp represents a resistance component between the first balanced terminal and the second balanced terminal when viewing a side of the first electrode and the second electrode from a side of the first balanced terminal and the second balanced terminal, and X represents an inductance between the first unbalanced terminal and the first balanced terminal, $1.5 \leq X/Rp \leq 5000$ is satisfied.

18 Claims, 20 Drawing Sheets

(52) U.S. Cl.
CPC ... *H01J 37/32449* (2013.01); *H01J 2237/327* (2013.01); *H01J 2237/334* (2013.01)

(56) References Cited

U.S. PATENT DOCUMENTS 4,131,533 A 12/1978 Bialko et al.
4,170,475 A 10/1979 Kuehnle
4,284,489 A 8/1981 Weber
4,284,490 A 8/1981 Weber
4,584,079 A 4/1986 Lee et al.
4,802,080 A 1/1989 Bossi et al.
4,871,421 A * 10/1989 Ogle ..... H01J 37/32082 204/298.34
4,887,005 A * 12/1989 Rough ..... H01J 37/32174 422/906
4,956,582 A * 9/1990 Bourassa ..... H05H 1/46 315/111.21
5,121,067 A * 6/1992 Marsland ..... H01L 27/0605 257/E27.012
5,147,493 A * 9/1992 Nishimura ..... H01J 37/32082 204/298.34
5,169,509 A 12/1992 Latz et al.
5,316,645 A * 5/1994 Yamagami ..... C23C 14/3435 204/192.12
5,330,578 A 7/1994 Sakama et al.
5,415,757 A 5/1995 Szcyrbowski et al.
5,464,499 A * 11/1995 Moslehi ..... C23C 16/4405 427/571
5,611,899 A 3/1997 Maass
5,698,082 A 12/1997 Teschner
5,718,815 A 2/1998 Szczyrbowski et al.
5,733,511 A * 3/1998 De Francesco ..... H05H 1/46 422/907
5,755,938 A 5/1998 Fukui et al.
5,803,973 A 9/1998 Szczyrbowski et al.
5,807,470 A * 9/1998 Szczyrbowski ..... H01J 37/3444 204/192.12
5,830,331 A 11/1998 Kim et al.
5,865,969 A 2/1999 Clarke
5,932,116 A 8/1999 Matsumoto et al.
5,989,999 A * 11/1999 Levine ..... C23C 16/5096 438/653
5,990,016 A 11/1999 Kim et al.
6,017,221 A * 1/2000 Flamm ..... H01J 37/321 204/192.32
6,046,641 A * 4/2000 Chawla ..... H03F 1/565 330/276
6,096,174 A 8/2000 Teschner et al.
6,239,404 B1 5/2001 Lea et al.
6,252,354 B1 * 6/2001 Collins ..... H01J 37/32174 156/345.28
6,273,022 B1 * 8/2001 Pu ..... H01J 37/321 118/723 MR
6,422,172 B1 7/2002 Tanaka et al.
6,517,912 B1 2/2003 Morfill et al.
6,568,346 B2 * 5/2003 Pu ..... H01J 37/321 156/345.46
6,703,080 B2 3/2004 Reyzelman et al.
6,818,103 B1 11/2004 Scholl
6,825,618 B2 * 11/2004 Pu ..... H01J 37/321 315/111.41
6,876,205 B2 4/2005 Walde et al.
6,885,154 B2 4/2005 Uchida et al.
6,913,703 B2 7/2005 Strang et al.
7,032,536 B2 4/2006 Fukuoka et al.
7,298,091 B2 * 11/2007 Pickard ..... H03H 7/38 156/345.28
7,445,690 B2 * 11/2008 Kasai ..... H05B 6/705 315/111.21
7,586,210 B2 * 9/2009 Wiedemuth ..... H01J 37/32431 307/31
7,670,455 B2 3/2010 Keller et al.
7,777,567 B2 8/2010 Polizzo
8,033,246 B2 10/2011 Wiedemuth
8,293,068 B2 10/2012 Koshimizu et al.
8,450,635 B2 5/2013 Dhindsa
8,647,585 B2 2/2014 Hancock
8,932,430 B2 1/2015 Srivastava et al.
8,992,723 B2 3/2015 Sorensen et al.
9,039,864 B2 5/2015 Baek et al.
9,121,786 B2 * 9/2015 Tie ..... G01M 1/22
9,147,555 B2 9/2015 Richter
9,245,776 B2 1/2016 Himori et al.
9,401,265 B2 * 7/2016 Michel ..... C23C 16/545
9,455,126 B2 * 9/2016 Valcore, Jr. ..... H01J 37/32082
9,564,360 B2 2/2017 Akasaka et al.
9,607,810 B2 * 3/2017 Valcore, Jr. ..... H01J 37/32981
9,620,337 B2 * 4/2017 Valcore, Jr. ..... G01R 31/40
9,640,367 B2 5/2017 Keller et al.
9,675,716 B2 6/2017 Hancock
9,779,196 B2 * 10/2017 Valcore, Jr. ..... G06F 30/36
9,875,881 B2 * 1/2018 Nagami ..... H01J 37/32183
10,081,869 B2 * 9/2018 Augustyniak ..... H01J 37/32752
10,083,817 B1 * 9/2018 Godyak ..... H05H 1/46
10,157,729 B2 * 12/2018 Valcore, Jr. ..... H01J 37/32082
RE47,276 E * 3/2019 Benjamin ..... H02M 3/335
10,224,463 B2 3/2019 Daigo
10,231,321 B2 * 3/2019 Valcore, Jr. ..... H03J 7/00
10,354,838 B1 * 7/2019 Mopidevi ..... H01L 21/6831
10,410,889 B2 9/2019 Sadjadi et al.
10,544,505 B2 1/2020 Yang et al.
10,553,406 B2 2/2020 Chang et al.
10,685,810 B2 * 6/2020 Mopidevi ..... H01J 37/3211
10,879,043 B2 * 12/2020 Selmo ..... H05H 1/24
11,013,075 B2 * 5/2021 Lester ..... H05B 6/50
11,114,287 B2 9/2021 Harris et al.
11,170,991 B2 * 11/2021 Sakane ..... H01J 37/32183
11,315,765 B2 * 4/2022 Yamawaku ..... H01J 37/32577
2001/0054383 A1 * 12/2001 Pu ..... H01J 37/321 156/345.48
2002/0022836 A1 * 2/2002 Goble ..... A61B 18/1206 606/41
2003/0087044 A1 5/2003 Willms et al.
2003/0215373 A1 11/2003 Reyzelman et al.
2004/0222184 A1 11/2004 Hayami et al.
2004/0262156 A1 12/2004 Seymour et al.
2005/0136604 A1 * 6/2005 Al-Bayati ..... H01L 29/7843 438/301
2005/0138577 A1 6/2005 Adamian
2005/0160987 A1 7/2005 Kasai et al.
2008/0050537 A1 2/2008 Godyak
2008/0258411 A1 * 10/2008 Miura ..... H01L 21/67109 279/128
2008/0308041 A1 12/2008 Koshiishi et al.
2009/0041640 A1 2/2009 Kasai et al.
2009/0075597 A1 3/2009 Degani et al.
2009/0085597 A1 * 4/2009 Burns ..... G01R 31/31723 324/50.01
2009/0242135 A1 * 10/2009 Koshimizu ..... H01J 37/32091 156/345.48
2010/0252199 A1 * 10/2010 Marakhtanov ..... C23C 16/5096 156/345.48
2010/0294433 A1 * 11/2010 Jianhui ..... H01J 37/32623 156/345.48
2011/0300694 A1 12/2011 Matsumoto et al.
2013/0017315 A1 1/2013 Lai et al.
2013/0105082 A1 * 5/2013 Melikyan ..... H05H 1/46 315/111.21
2013/0337657 A1 * 12/2013 Savas ..... C23C 16/509 118/723 MP
2015/0054405 A1 * 2/2015 Nettesheim ..... H05H 1/36 315/111.21
2015/0165752 A1 6/2015 Plach et al.
2015/0170882 A1 6/2015 Yamawaku et al.
2015/0255258 A1 9/2015 Nozawa et al.
2016/0240351 A1 8/2016 Burgess et al.
2016/0289837 A1 * 10/2016 Savas ..... C23C 16/545
2016/0307743 A1 * 10/2016 Brown ..... H01J 37/32183
2016/0336084 A1 11/2016 Laguardia et al.
2017/0018401 A1 1/2017 Rudolph
2017/0084432 A1 3/2017 Valcore, Jr.
2017/0213734 A9 * 7/2017 Marakhtanov .... H01J 37/32091

(56) References Cited

U.S. PATENT DOCUMENTS

| | | | | |
|---|---|---|---|---|
| 2017/0232122 | A1 | 8/2017 | Hancock | |
| 2018/0130640 | A1 | 5/2018 | Gregor | |
| 2018/0269035 | A1* | 9/2018 | Selmo | H01J 37/32174 |
| 2018/0318459 | A1* | 11/2018 | Hancock | A61L 2/26 |
| 2019/0221405 | A1 | 7/2019 | Yamawaku et al. | |
| 2020/0126763 | A1* | 4/2020 | Sekiya | H01L 21/3065 |
| 2020/0126764 | A1* | 4/2020 | Inoue | H01J 37/3435 |
| 2020/0126766 | A1* | 4/2020 | Sekiya | H01J 37/32174 |
| 2020/0126767 | A1* | 4/2020 | Takeda | H01J 37/32174 |
| 2020/0126768 | A1* | 4/2020 | Inoue | H01J 37/3255 |
| 2020/0161096 | A1 | 5/2020 | Chang et al. | |
| 2021/0005429 | A1* | 1/2021 | Tanabe | H01J 37/32183 |
| 2021/0118649 | A1* | 4/2021 | Huh | H01J 37/32183 |
| 2022/0051878 | A1 | 2/2022 | Sekiya et al. | |

FOREIGN PATENT DOCUMENTS

| | | | | |
|---|---|---|---|---|
| CN | 101478857 | A | 7/2009 | |
| CN | 101546697 | A | 9/2009 | |
| CN | 102479657 | A | 5/2012 | |
| CN | 103091042 | A | 5/2013 | |
| CN | 103094042 | A | 5/2013 | |
| CN | 104024471 | A | 9/2014 | |
| CN | 105887050 | A | 8/2016 | |
| CN | 106024568 | A | 10/2016 | |
| DE | 19713637 | A1 | 10/1998 | |
| EP | 1748687 | A1 | 1/2007 | |
| JP | S53-141937 | | 11/1978 | |
| JP | S53141937 | U | 11/1978 | |
| JP | S55035465 | B2 | 9/1980 | |
| JP | S 62133065 | A | 6/1987 | |
| JP | H02501608 | A | 5/1990 | |
| JP | H02156080 | A | 6/1990 | |
| JP | H02156081 | A | 6/1990 | |
| JP | H02156082 | A | 6/1990 | |
| JP | H02156083 | A | 6/1990 | |
| JP | H04-317325 | A | 11/1992 | |
| JP | H10-261621 | A | 9/1998 | |
| JP | H11307299 | A | 11/1999 | |
| JP | 2000-030896 | A | 1/2000 | |
| JP | 2000-195851 | A | 7/2000 | |
| JP | 2000-294543 | A | 10/2000 | |
| JP | 2002-141292 | A | 5/2001 | |
| JP | 2001122690 | A | 5/2001 | |
| JP | 2001-181848 | A | 7/2001 | |
| JP | 2001-518230 | A | 10/2001 | |
| JP | 2002004040 | A | 1/2002 | |
| JP | 2002118101 | | 4/2002 | |
| JP | 2003-512526 | A | 4/2003 | |
| JP | 2003155556 | A | 5/2003 | |
| JP | 2005026540 | A | 1/2005 | |
| JP | 2005130376 | A | 5/2005 | |
| JP | 2005303257 | A | 10/2005 | |
| JP | 2006336084 | A | 12/2006 | |
| JP | 2008294465 | A * | 12/2008 | C23C 16/24 |
| JP | 2008294465 | A | 12/2008 | |
| JP | 2008300322 | A | 12/2008 | |
| JP | 2009021634 | A | 1/2009 | |
| JP | 2009105030 | A | 5/2009 | |
| JP | 2009302566 | A * | 12/2009 | |
| JP | 2009302566 | A | 12/2009 | |
| JP | 2010045664 | A | 2/2010 | |
| JP | 2010109157 | | 5/2010 | |
| JP | 2010255061 | A | 11/2010 | |
| JP | 2011-138907 | A | 7/2011 | |
| JP | 2011144450 | A | 7/2011 | |
| JP | 4909523 | B2 | 4/2012 | |
| JP | 2012142332 | A | 7/2012 | |
| JP | 2012174682 | A | 9/2012 | |
| JP | 2013139642 | A | 7/2013 | |
| JP | 2014049541 | A | 3/2014 | |
| JP | 2015-115216 | A | 6/2015 | |
| JP | 5824072 | B2 | 11/2015 | |
| JP | 2016225376 | A | 12/2016 | |
| JP | 2017211144 | A | 11/2017 | |
| JP | 6280677 | B1 | 2/2018 | |
| JP | 6309683 | B1 | 4/2018 | |
| TW | 200741794 | A | 11/2007 | |
| TW | 201311059 | A | 3/2013 | |
| TW | 201423827 | A | 6/2014 | |
| TW | I492294 | B | 7/2015 | |
| TW | 201532220 | A | 8/2015 | |
| TW | 201643932 | A | 12/2016 | |
| TW | I560767 | B | 12/2016 | |
| TW | I575107 | B | 3/2017 | |
| TW | I 601309 | B | 10/2017 | |
| WO | 8902695 | A1 | 3/1989 | |
| WO | 01/29278 | A1 | 4/2001 | |
| WO | 2010024128 | A1 | 3/2010 | |
| WO | 2010041679 | A1 | 4/2010 | |
| WO | 2012/095961 | A1 | 7/2012 | |
| WO | 2019/004191 | A1 | 1/2019 | |

OTHER PUBLICATIONS

Office Action (Notice of Preliminary Rejection) dated Apr. 19, 2021, by the Korean Patent Office in corresponding Korean Patent Application No. 10-2020-7001366, and an English Translation of the Office Action. (14 pages).

Office Action (Notice of Preliminary Rejection) dated Apr. 26, 2021, by the Korean Patent Office in corresponding Korean Patent Application No. 10-2020-7001366, and an English Translation of the Office Action. (9 pages).

Office Action (Grant of Patent) dated Apr. 27, 2021, by the Korean Patent Office in corresponding Korean Patent Application No. 10-2020-7001397, and an English Translation of the Office Action. (4 pages).

International Search Report (PCT/ISA/210) and translation and Written Opinion (PCT/ISA/237) dated Sep. 11, 2018, by the Japanese Patent Office as the International Searching Authority for International Application No. PCT/JP2018/024150.

Office Action Summary dated Jan. 6, 2021, by the U.S. Patent and Trademark Office in U.S. Appl. No. 16/720,154. (27 pages).

Office Action Summary dated Mar. 15, 2021, by the U.S. Patent and Trademark Office in U.S. Appl. No. 16/720,154. (19 pages).

Office Action dated Aug. 19, 2021, by the U.S. Patent and Trademark Office in corresponding U.S. Appl. No. 17/023,675.

International Search Report (PCT/ISA/210) dated Sep. 19, 2017, by the Japanese Patent Office as the International Searching Authority for International Application No. PCT/JP2017/023611.

Written Opinion (PCT/ISA/237) dated Sep. 19, 2017, by the Japanese Patent Office as the International Searching Authority for International Application No. PCT/JP2017/023611.

Supplemental European Search Report issued in corresponding European Application No. 18824433, dated Apr. 30, 2020 (8 pages).

Co-Pending U.S. Appl. No. 17/023,675, filed Sep. 17, 2020.

First Office Action dated Jun. 2, 2021, by the Chinese Patent Office in Chinese Patent Application No. 201880042465, and an English Translation of the Office Action. (23 pages).

First Office Action dated Jun. 2, 2021, by the Chinese Patent Office in Chinese Patent Application No. 201880042477.2, and an English Translation of the Office Action. (20 pages).

First Office Action dated Jun. 2, 2021, by the Chinese Patent Office in Chinese Patent Application No. 201780092518.4, and an English Translation of the Office Action. (21 pages).

First Office Action dated Jun. 2, 2021, by the Chinese Patent Office in Chinese Patent Application No. 201780092519.9, and an English Translation of the Office Action. (23 pages).

First Office Action dated Jun. 3, 2021, by the Chinese Patent Office in Chinese Patent Application No. 201880042506.5, and an English Translation of the Office Action. (21 pages).

Notice of Allowance dated Sep. 20, 2021, by the U.S. Patent and Trademark Office in U.S. Appl. No. 16/720,154.

Office Action issued in corresponding U.S. Appl. No. 16/720,156, dated Oct. 25, 2021 (71 pages).

Extended European Search Report issued in European Patent Application No. 18924031.0, dated Feb. 15, 2022, (9 pages). European Patent Application No. 189240031.0 corresponds to U.S. Appl. No. 17/023,675.

(56) References Cited

OTHER PUBLICATIONS

Office Action issued in U.S. Appl. No. 16/720,156, dated Apr. 1, 2022 (19 pages).
Office Action issued in U.S. Appl. No. 16/720,087, dated Apr. 7, 2022 (84 pages).
Office Action issued in U.S. Appl. No. 16/720,173, dated May 12, 2022 (27 pages).
Non Final Office Action received for U.S. Appl. No. 16/720,154, dated May 26, 2022, 16 pages.
Notice of Allowance received for U.S. Appl. No. 17/023,675, dated May 26, 2022, 12 pages.
Notice of Reasons for Refusal issued in corresponding Japanese Patent Application No. 2019-012426, dated Aug. 15, 2022, with English Translation (8 pages).
Notice of Reasons for Refusal issued in corresponding Japanese Patent Application No. 2019-012419, dated Aug. 15, 2022, with English Translation (14 pages).

* cited by examiner

FIG. 4

| TOTAL CURRENT I1 | 1 | 1 | 1 | 1 | 1 | 1 | 1 | 1 | 1 | 1 | 1 |
|---|---|---|---|---|---|---|---|---|---|---|---|
| CURRENT I2' | 1 | 0.9999 | 0.9997 | 0.999 | 0.997 | 0.99 | 0.97 | 0.9 | 0.68 | 0.55 | 0.29 |
| CURRENT I3 | 0 | 0.0001 | 0.0003 | 0.001 | 0.003 | 0.01 | 0.03 | 0.1 | 0.32 | 0.45 | 0.71 |
| ISO[dB]= 20log(I3/I2') | $-\infty$ | -80.0 | -70.0 | -60.0 | -50.0 | -40.0 | -30.0 | -20.0 | -10.0 | -7.0 | -3.0 |
| $\alpha$=X/Rp | $\infty$ | 5000 | 1582 | 500 | 158 | 50 | 15.8 | 5.0 | 1.5 | 1.0 | 0.5 |

PLASMA PROCESSING APPARATUS

CROSS-REFERENCE TO RELATED APPLICATION(S)

This application is a continuation of International Patent Application No. PCT/JP2017/023611 filed Jun. 27, 2017, the entire disclosures of which is incorporated herein by reference.

TECHNICAL FIELD

The present invention relates to a plasma processing apparatus.

BACKGROUND ART

There is provided a plasma processing apparatus that generates plasma by applying a high frequency between two electrodes and processes a substrate by the plasma. Such plasma processing apparatus can operate as an etching apparatus or a sputtering apparatus by the bias and/or the area ratio of the two electrodes. The plasma processing apparatus configured as a sputtering apparatus includes the first electrode that holds a target and the second electrode that holds a substrate. A high frequency is applied between the first and second electrodes, and plasma is generated between the first and second electrodes (between the target and the substrate). When plasma is generated, a self-bias voltage is generated on the surface of the target. This causes ions to collide against the target, and the particles of a material constituting the target are discharged from the target.

PTL 1 describes a sputtering apparatus including a grounded chamber, a target electrode connected to an RF source via impedance matching circuitry, and a substrate holding electrode grounded via a substrate electrode tuning circuit.

In the sputtering apparatus described in PTL 1, the chamber can function as an anode in addition to the substrate holding electrode. The self-bias voltage can depend on the state of a portion that can function as a cathode and the state of a portion that can function as an anode. Therefore, if the chamber functions as an anode in addition to the substrate holding electrode, the self-bias voltage can change depending on the state of a portion of the chamber that functions as an anode. The change in self-bias voltage changes a plasma potential, and the change in plasma potential can influence the characteristic of a film to be formed.

If a film is formed on a substrate using the sputtering apparatus, a film can also be formed on the inner surface of the chamber. This may change the state of the portion of the chamber that can function as an anode. Therefore, if the sputtering apparatus is continuously used, the self-bias voltage changes depending on the film formed on the inner surface of the chamber, and the plasma potential can also change. Consequently, if the sputtering apparatus is used for a long period, it is conventionally difficult to keep the characteristic of the film formed on the substrate constant.

Similarly, if the etching apparatus is used for a long period, the self-bias voltage changes depending on the film formed on the inner surface of the chamber, and this may change the plasma potential. Consequently, it is difficult to keep the etching characteristic of the substrate constant.

CITATION LIST

Patent Literature

PTL 1: Japanese Patent Publication No. 55-35465

SUMMARY OF INVENTION

Technical Problem

The present invention has been made based on the above problem recognition, and has as its object to provide a technique advantageous in stabilizing a plasma potential in long-term use.

According to the first aspect of the present invention, there is provided a plasma processing apparatus comprising a balun including a first unbalanced terminal, a second unbalanced terminal, a first balanced terminal, and a second balanced terminal, a grounded vacuum container, a first electrode electrically connected to the first balanced terminal, and a second electrode electrically connected to the second balanced terminal, wherein when Rp represents a resistance component between the first balanced terminal and the second balanced terminal when viewing a side of the first electrode and the second electrode from a side of the first balanced terminal and the second balanced terminal, and X represents an inductance between the first unbalanced terminal and the first balanced terminal, $1.5 \leq X/Rp \leq 5000$ is satisfied.

According to the present invention, there is provided a technique advantageous in stabilizing a plasma potential in long-term use.

BRIEF DESCRIPTION OF DRAWINGS

FIG. 4 is a table exemplifying the relationship among currents I1 (=I2), I2', and I3, ISO, and $\alpha$(=X/Rp);

DESCRIPTION OF EMBODIMENTS

The present invention will be described below with reference to the accompanying drawings by way of exemplary embodiments.

Figure 1:
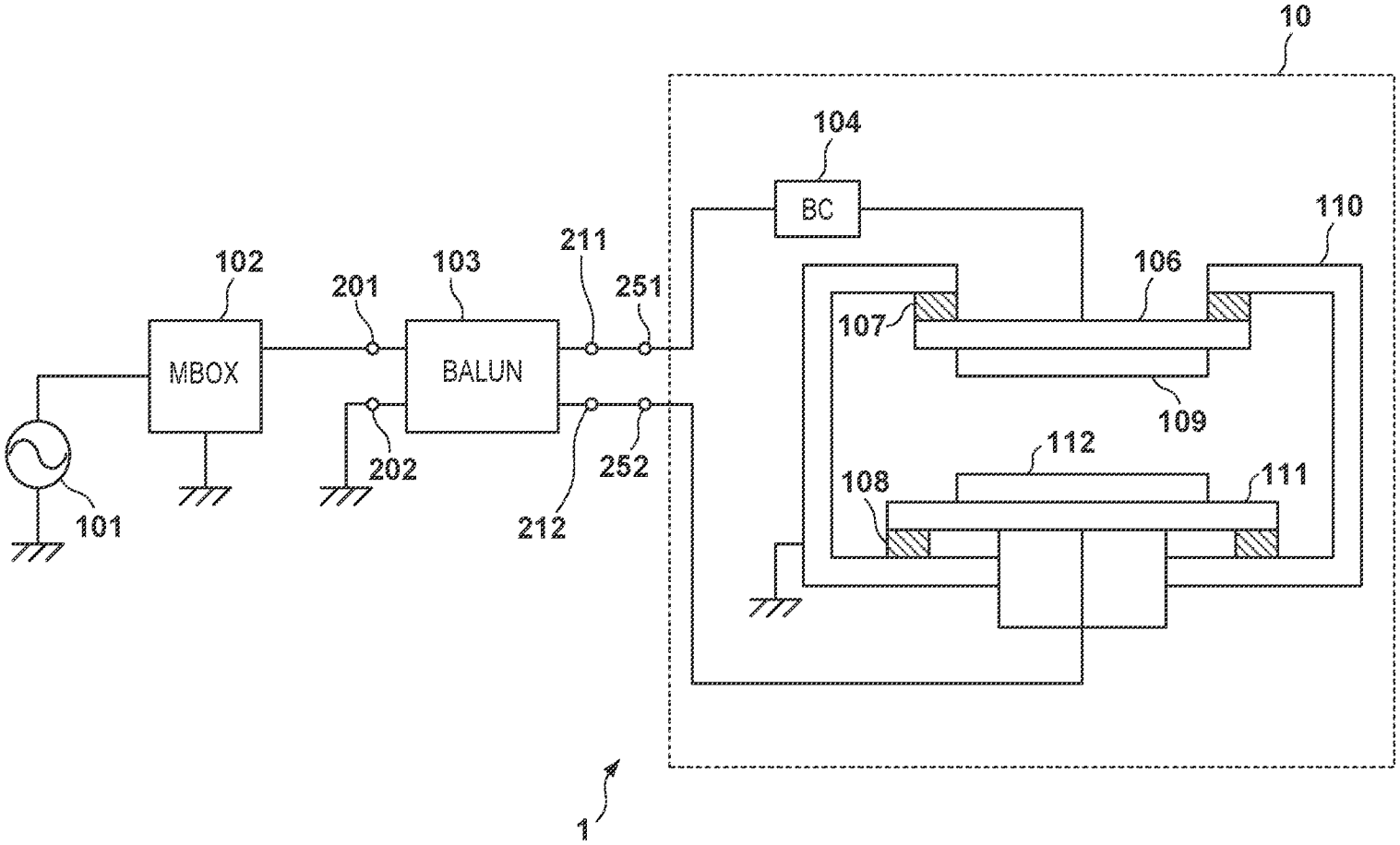
FIG. 1 is a circuit diagram schematically showing the arrangement of a plasma processing apparatus according to the first embodiment of the present invention.

FIG. 1 schematically shows the arrangement of a plasma processing apparatus 1 according to the first embodiment of the present invention. The plasma processing apparatus 1 includes a balun (balanced/unbalanced conversion circuit) 103, a vacuum container 110, a first electrode 106, and a second electrode 111. Alternatively, it may be understood that the plasma processing apparatus 1 includes the balun 103 and a main body 10, and the main body 10 includes the vacuum container 110, the first electrode 106, and the second electrode 111. The main body 10 includes a first terminal 251 and a second terminal 252.

The balun 103 includes a first unbalanced terminal 201, a second unbalanced terminal 202, a first balanced terminal 211, and a second balanced terminal 212. An unbalanced circuit is connected to the first unbalanced terminal 201 and the second unbalanced terminal 202 of the balun 103, and a balanced circuit is connected to the first balanced terminal 211 and the second balanced terminal 212 of the balun 103. The vacuum container 110 is formed by a conductor, and is grounded.

In the first embodiment, the first electrode 106 serves as a cathode, and holds a target 109. The target 109 can be, for example, an insulator material or a conductor material. Furthermore, in the first embodiment, the second electrode 111 serves as an anode, and holds a substrate 112. The plasma processing apparatus 1 according to the first embodiment can operate as a sputtering apparatus that forms a film on the substrate 112 by sputtering the target 109. The first electrode 106 is electrically connected to the first balanced terminal 211, and the second electrode 111 is electrically connected to the second balanced terminal 212. When the first electrode 106 and the first balanced terminal 211 are electrically connected to each other, this indicates that a current path is formed between the first electrode 106 and the first balanced terminal 211 so that a current flows between the first electrode 106 and the first balanced terminal 211. Similarly, in this specification, when a and b are electrically connected, this indicates that a current path is formed between a and b so that a current flows between a and b.

The above arrangement can be understood as an arrangement in which the first electrode 106 is electrically connected to the first terminal 251, the second electrode 111 is electrically connected to the second terminal 252, the first terminal 251 is electrically connected to the first balanced terminal 211, and the second terminal 252 is electrically connected to the second balanced terminal 212.

In the first embodiment, the first electrode 106 and the first balanced terminal 211 (first terminal 251) are electrically connected via a blocking capacitor 104. The blocking capacitor 104 blocks a DC current between the first balanced terminal 211 and the first electrode 106 (or between the first balanced terminal 211 and the second balanced terminal 212). Instead of providing the blocking capacitor 104, an impedance matching circuit 102 (to be described later) may be configured to block a DC current flowing between the first unbalanced terminal 201 and the second unbalanced terminal 202. The first electrode 106 can be supported by the vacuum container 110 via an insulator 107. The second electrode 111 can be supported by the vacuum container 110 via an insulator 108. Alternatively, the insulator 108 can be arranged between the second electrode 111 and the vacuum container 110.

The plasma processing apparatus 1 can further include a high-frequency power supply 101, and the impedance matching circuit 102 arranged between the high-frequency power supply 101 and the balun 103. The high-frequency power supply 101 supplies a high frequency (high-frequency current, high-frequency voltage, and high-frequency power) between the first unbalanced terminal 201 and the second unbalanced terminal 202 of the balun 103 via the impedance matching circuit 102. In other words, the high-frequency power supply 101 supplies a high frequency (high-frequency current, high-frequency voltage, and high-frequency power) between the first electrode 106 and the second electrode 111 via the impedance matching circuit 102, the balun 103, and the blocking capacitor 104. Alternatively, the high-frequency power supply 101 can be understood to supply a high frequency between the first terminal 251 and the second terminal 252 of the main body 10 via the impedance matching circuit 102 and the balun 103.

A gas (for example, Ar, Kr, or Xe gas) is supplied to the internal space of the vacuum container 110 through a gas supply unit (not shown) provided in the vacuum container 110. In addition, the high-frequency power supply 101 supplies a high frequency between the first electrode 106 and the second electrode 111 via the impedance matching circuit 102, the balun 103, and the blocking capacitor 104. This generates plasma between the first electrode 106 and the second electrode 111, and generates a self-bias voltage on the surface of the target 109 to cause ions in the plasma to collide against the surface of the target 109, thereby discharging, from the target 109, the particles of a material constituting the target 109. Then, the particles form a film on the substrate 112.

Figure 2A:
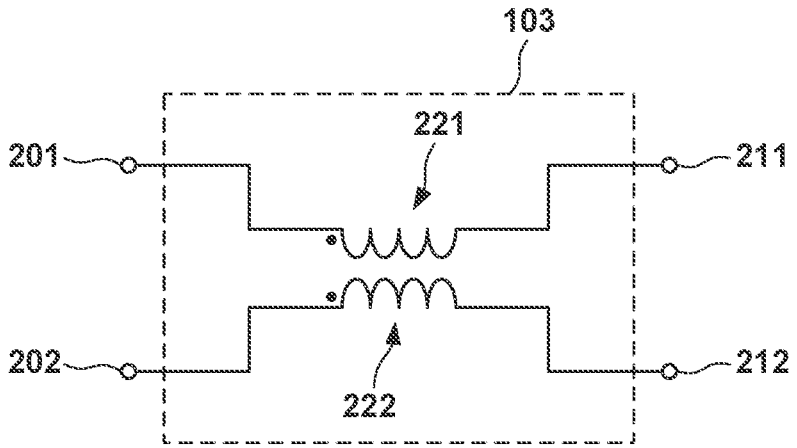
FIG. 2A is a circuit diagram showing an example of the arrangement of a balun.

FIG. 2A shows an example of the arrangement of the balun 103. The balun 103 shown in FIG. 2A includes a first coil 221 that connects the first unbalanced terminal 201 and the first balanced terminal 211, and a second coil 222 that connects the second unbalanced terminal 202 and the second balanced terminal 212. The first coil 221 and the second coil 222 are coils having the same number of turns, and share an iron core.

Figure 2B:
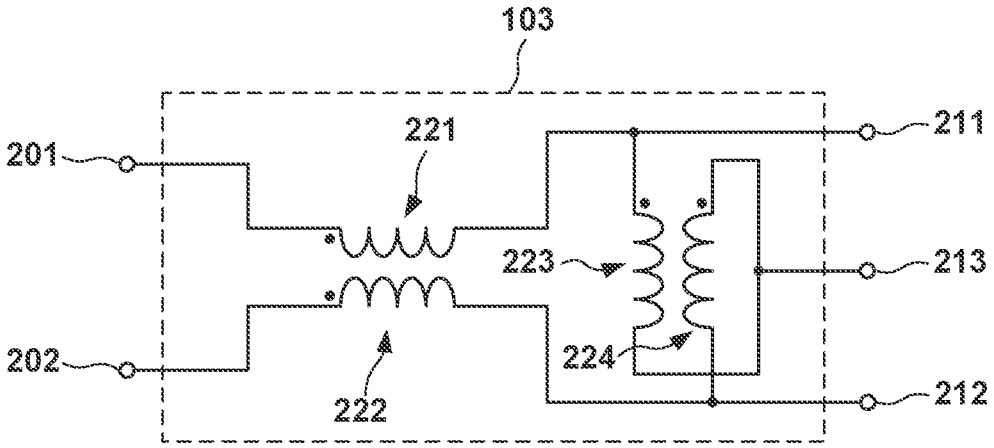
FIG. 2B is a circuit diagram showing another example of the arrangement of the balun.

FIG. 2B shows another example of the arrangement of the balun 103. The balun 103 shown in FIG. 2B includes a first coil 221 that connects the first unbalanced terminal 201 and the first balanced terminal 211, and a second coil 222 that connects the second unbalanced terminal 202 and the second balanced terminal 212. The first coil 221 and the second coil 222 are coils having the same number of turns, and share an iron core. The balun 103 shown in FIG. 2B further includes a third coil 223 and a fourth coil 224 both of which are connected between the first balanced terminal 211 and the second balanced terminal 212. The third coil 223 and the fourth coil 224 are configured so that the voltage of a connection node 213 of the third coil 223 and the fourth coil 224 is set as the midpoint between the voltage of the first balanced terminal 211 and that of the second balanced terminal 212. The third coil 223 and the fourth coil 224 are coils having the same number of turns, and share an iron core. The connection node 213 may be grounded, may be connected to the vacuum container 110, or may be floated.

The function of the balun 103 will be described with reference to FIG. 3. Let I1 be a current flowing through the first unbalanced terminal 201, I2 be a current flowing through the first balanced terminal 211, I2' be a current flowing through the second unbalanced terminal 202, and I3 be a current, of the current I2, flowing to ground. When I3=0, that is, no current flows to ground on the balanced circuit side, the isolation performance of the balanced circuit with respect to ground is highest. When I3=I2, that is, all the current I2 flowing through the first balanced terminal 211 flows to ground, the isolation performance of the balanced circuit with respect to ground is lowest. An index ISO representing the degree of the isolation performance is given by:

$$ISO[\text{dB}]=20\log(I3/I2')$$

Under this definition, as the absolute value of the index ISO is larger, the isolation performance is higher.

Figure 3:
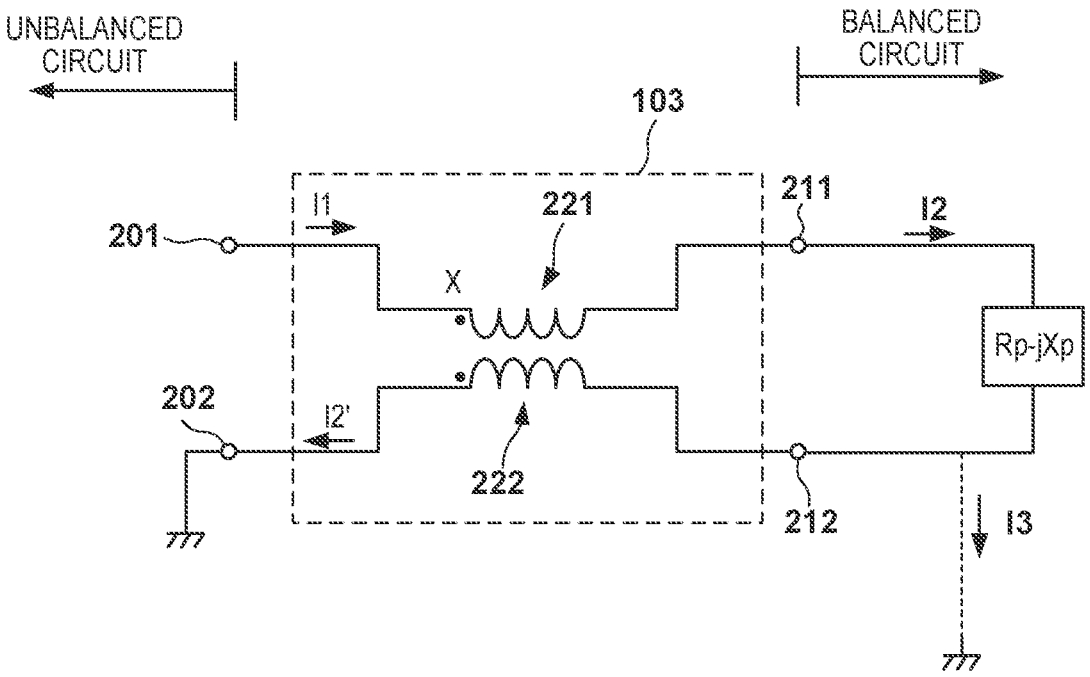
FIG. 3 is a circuit diagram for explaining the function of a balun 103.

In FIG. 3, Rp−jXp represents an impedance (including the reactance of the blocking capacitor 104) when viewing the side of the first electrode 106 and the second electrode 111 (the side of the main body 10) from the side of the first balanced terminal 211 and the second balanced terminal 212 in a state in which plasma is generated in the internal space of the vacuum container 110. Rp represents a resistance component, and −Xp represents a reactance component. Furthermore, in FIG. 3, X represents the reactance component (inductance component) of the impedance of the first coil 221 of the balun 103. ISO has a correlation with X/Rp.

FIG. 4 exemplifies the relationship among the currents I1 (=I2), I2', and I3, ISO, and α(=X/Rp). The present inventor found that when 1.5≤X/Rp≤5000 is satisfied, the potential (plasma potential) of plasma formed in the internal space (the space between the first electrode 106 and the second electrode 111) of the vacuum container 110 is insensitive to the state of the inner surface of the vacuum container 110. When the plasma potential is insensitive to the state of the inner surface of the vacuum container 110, this indicates that it is possible to stabilize the plasma potential even if the plasma processing apparatus 1 is used for a long period. 1.5≤X/Rp≤5000 corresponds to −10.0 dB≥ISO≥−80 dB.

Figure 5A:
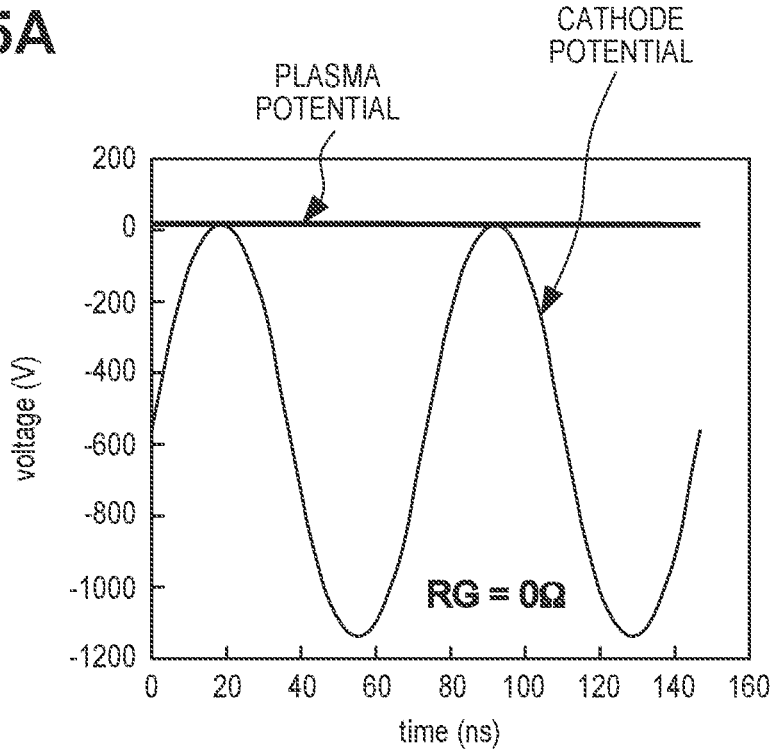
FIG. 5A is a timing chart showing a result of simulating a plasma potential and a cathode potential when $1.5 \leq X/Rp \leq 5000$ is satisfied.
Figure 5B:
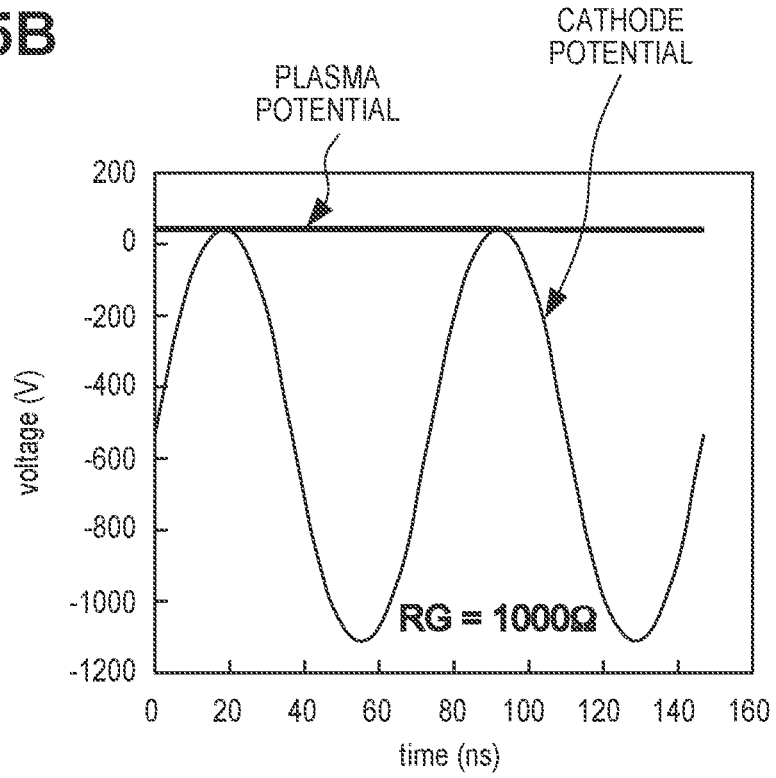
FIG. 5B is a timing chart showing a result of simulating a plasma potential and a cathode potential when $1.5 \leq X/Rp \leq 5000$ is satisfied.
Figure 5C:
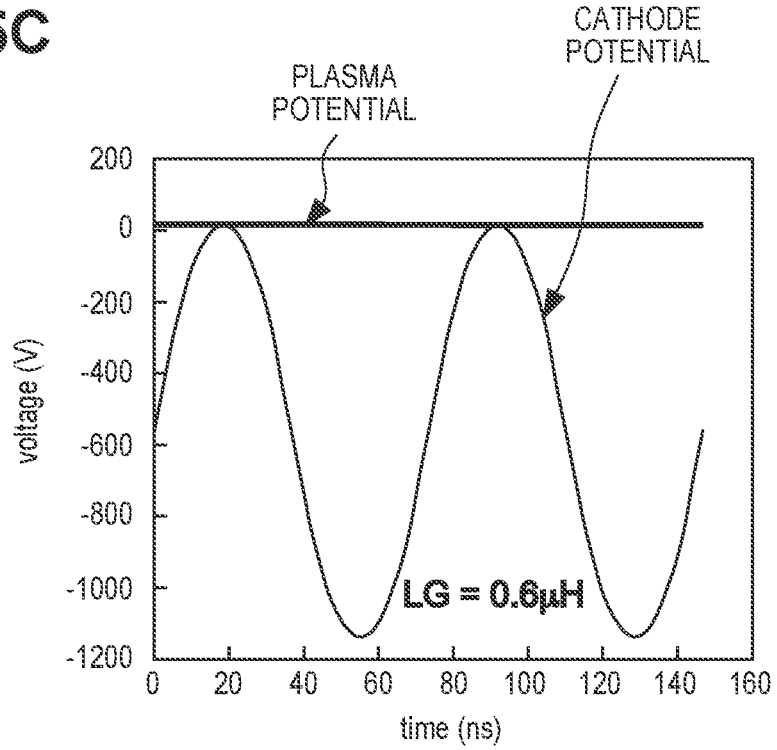
FIG. 5C is a timing chart showing a result of simulating a plasma potential and a cathode potential when $1.5 \leq X/Rp \leq 5000$ is satisfied.
Figure 5D:
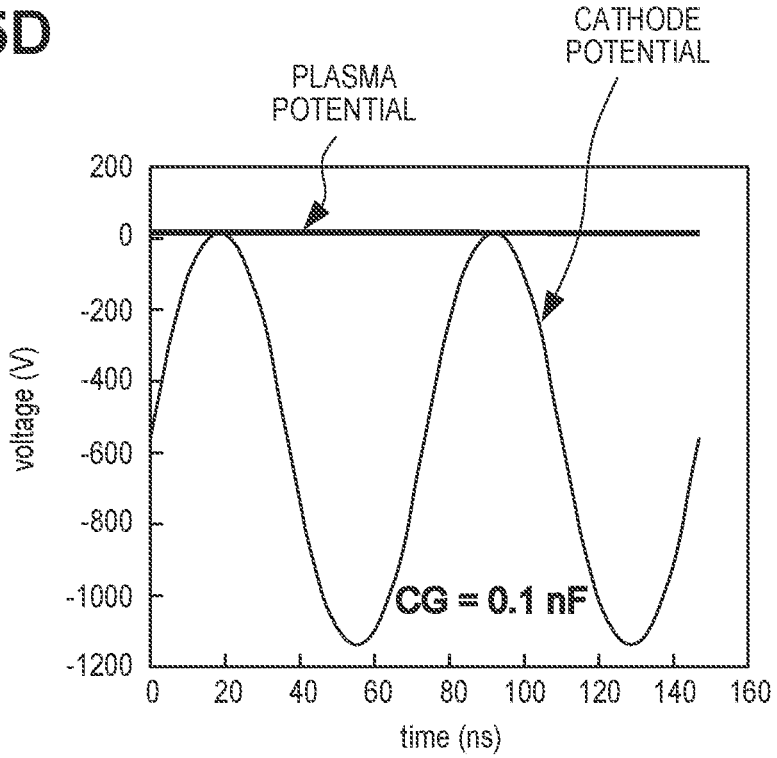
FIG. 5D is a timing chart showing a result of simulating a plasma potential and a cathode potential when $1.5 \leq X/Rp \leq 5000$ is satisfied.

FIGS. 5A to 5D each show a result of simulating the plasma potential and the potential (cathode potential) of the first electrode 106 when 1.5≤X/Rp≤5000 is satisfied. FIG. 5A shows the plasma potential and the cathode potential in a state in which no film is formed on the inner surface of the vacuum container 110. FIG. 5B shows the plasma potential and the cathode potential in a state in which a resistive film (1,000Ω) is formed on the inner surface of the vacuum container 110. FIG. 5C shows the plasma potential and the cathode potential in a state in which an inductive film (0.6 μH) is formed on the inner surface of the vacuum container 110. FIG. 5D shows the plasma potential and the cathode potential in a state in which a capacitive film (0.1 nF) is formed on the inner surface of the vacuum container 110. With reference to FIGS. 5A to 5D, it is understood that when 1.5≤X/Rp≤5000 is satisfied, the plasma potential is stable in various states of the inner surface of the vacuum container 110.

Figure 6A:
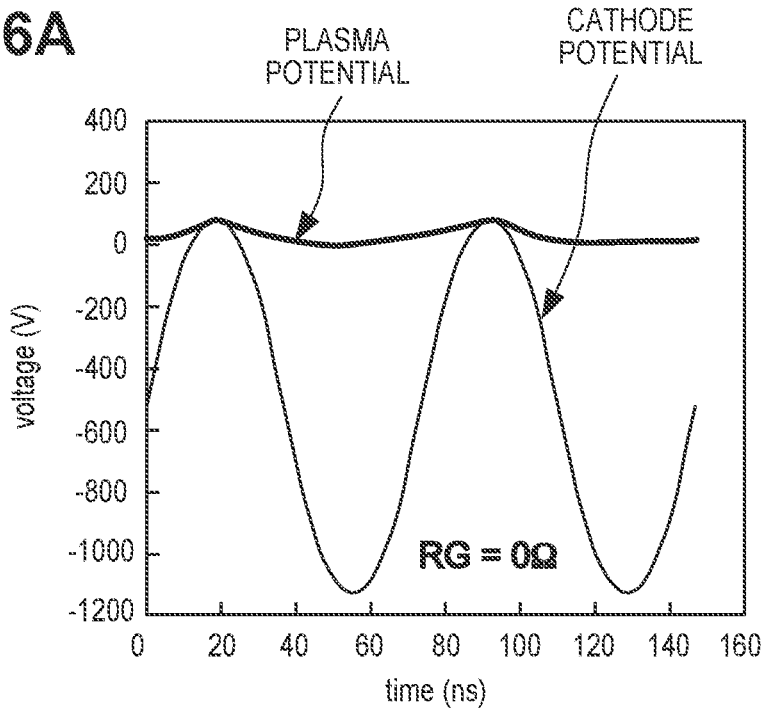
FIG. 6A is a timing chart showing a result of simulating a plasma potential and a cathode potential when $1.5 \leq X/Rp \leq 5000$ is not satisfied.
Figure 6B:
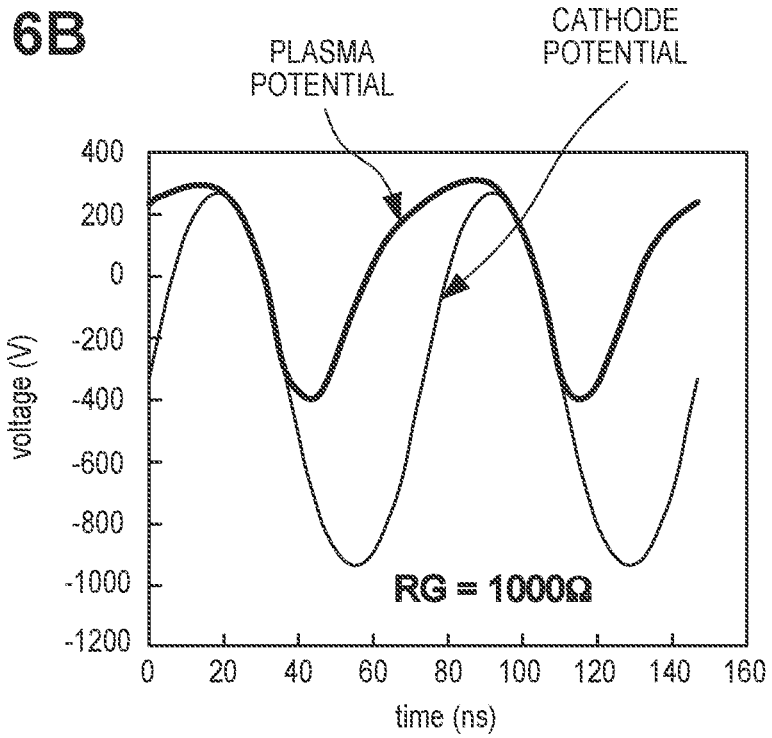
FIG. 6B is a timing chart showing a result of simulating a plasma potential and a cathode potential when $1.5 \leq X/Rp \leq 5000$ is not satisfied.
Figure 6C:
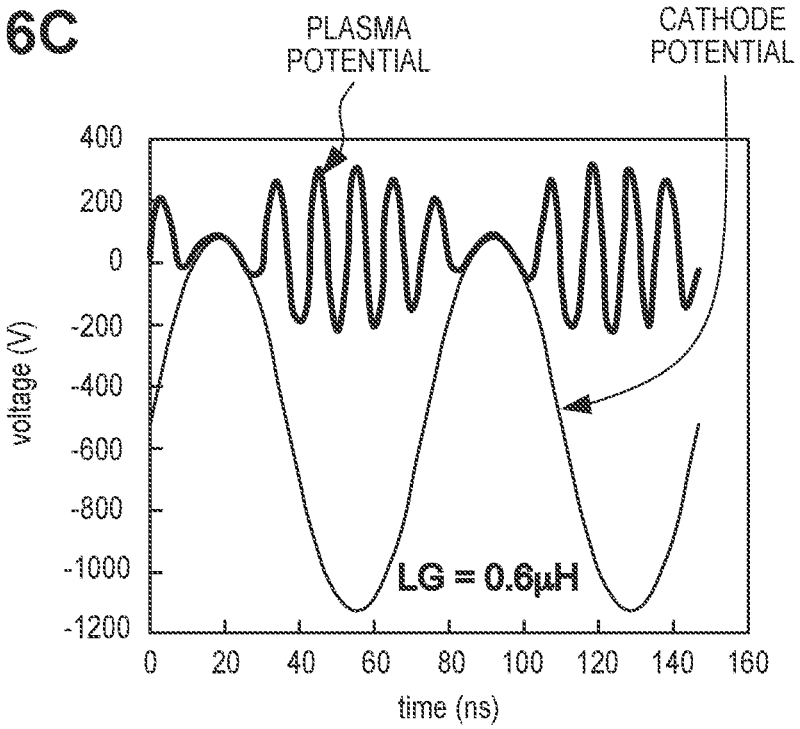
FIG. 6C is a timing chart showing a result of simulating a plasma potential and a cathode potential when $1.5 \leq X/Rp \leq 5000$ is not satisfied.
Figure 6D:
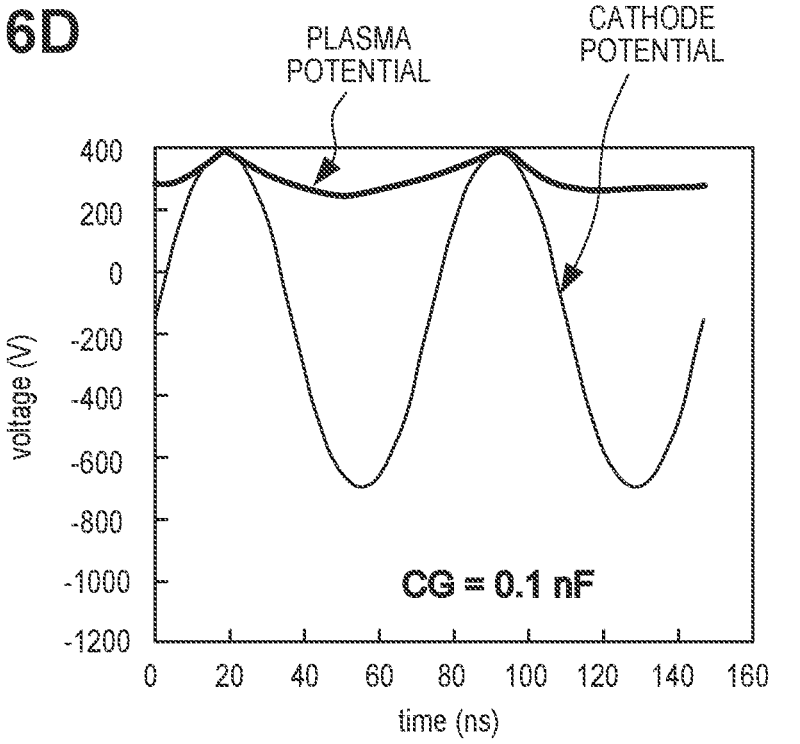
FIG. 6D is a timing chart showing a result of simulating a plasma potential and a cathode potential when 1.5≤X/Rp≤5000 is not satisfied.

FIGS. 6A to 6D each show a result of simulating the plasma potential and the potential (cathode potential) of the first electrode 106 when 1.5≤X/Rp≤5000 is not satisfied. FIG. 6A shows the plasma potential and the cathode potential in a state in which no film is formed on the inner surface of the vacuum container 110. FIG. 6B shows the plasma potential and the cathode potential in a state in which a resistive film (1,000Ω) is formed on the inner surface of the vacuum container 110. FIG. 6C shows the plasma potential and the cathode potential in a state in which an inductive film (0.6 μH) is formed on the inner surface of the vacuum container 110. FIG. 6D shows the plasma potential and the cathode potential in a state in which a capacitive film (0.1 nF) is formed on the inner surface of the vacuum container 110. With reference to FIGS. 6A to 6D, it is understood that when 1.5≤X/Rp≤5000 is not satisfied, the plasma potential changes depending on the state of the inner surface of the vacuum container 110.

In both the case in which X/Rp>5000 (for example, X/Rp=∞) is satisfied and the case in which X/Rp<1.5 (for example, X/Rp=1.0 or X/Rp=0.5) is satisfied, the plasma potential readily changes depending on the state of the inner surface of the vacuum container 110. If X/Rp>5000 is satisfied, in a state in which no film is formed on the inner surface of the vacuum container 110, discharge occurs only between the first electrode 106 and the second electrode 111. However, if X/Rp>5000 is satisfied, when a film starts to be formed on the inner surface of the vacuum container 110, the plasma potential sensitively reacts to this, and the results exemplified in FIGS. 6A to 6D are obtained. On the other hand, when X/Rp<1.5 is satisfied, a current flowing to ground via the vacuum container 110 is large. Therefore, the influence of the state of the inner surface of the vacuum container 110 (the electrical characteristic of a film formed on the inner surface) is conspicuous, and the plasma potential changes depending on formation of a film. Thus, as described above, the plasma processing apparatus 1 should be configured to satisfy $1.5 \leq X/Rp \leq 5000$.

Figure 7:
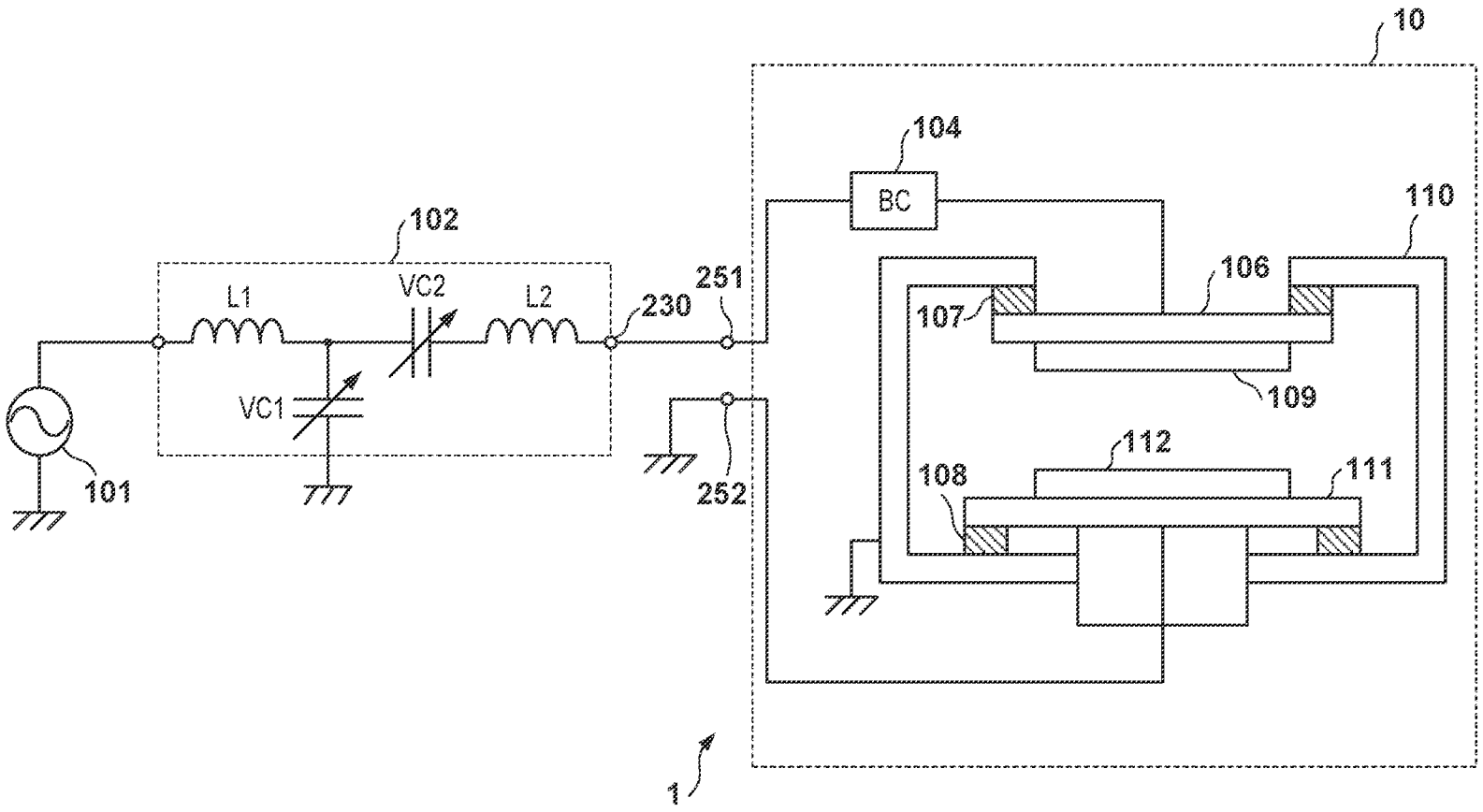
FIG. 7 is a circuit diagram exemplifying a method of confirming Rp−jXp.

A method of deciding Rp−jXp (it is desired to actually know only Rp) will be exemplified with reference to FIG. 7. The balun 103 is detached from the plasma processing apparatus 1 and an output terminal 230 of the impedance matching circuit 102 is connected to the first terminal 251 (blocking capacitor 104) of the main body 10. Furthermore, the second terminal 252 (second electrode 111) of the main body 10 is grounded. In this state, the high-frequency power supply 101 supplies a high frequency to the first terminal 251 of the main body 10 via the impedance matching circuit 102. In the example shown in FIG. 7, the impedance matching circuit 102 is equivalently formed by coils L1 and L2 and variable capacitors VC1 and VC2. It is possible to generate plasma by adjusting the capacitance values of the variable capacitors VC1 and VC2. In the state in which the plasma is stable, the impedance of the impedance matching circuit 102 matches the impedance Rp−jXp on the side of the main body 10 (the side of the first electrode 106 and the second electrode 111) when the plasma is generated. The impedance of the impedance matching circuit 102 at this time is given by Rp+jXp.

Therefore, Rp−jXp (it is desired to actually know only Rp) can be obtained based on the impedance Rp+jXp of the impedance matching circuit 102 when the impedance is matched. Alternatively, for example, Rp−jXp can be obtained by simulation based on design data.

Based on Rp obtained in this way, the reactance component (inductance component) X of the impedance of the first coil 221 of the balun 103 is decided so as to satisfy $1.5 \leq X/Rp \leq 5000$.

Figure 8:
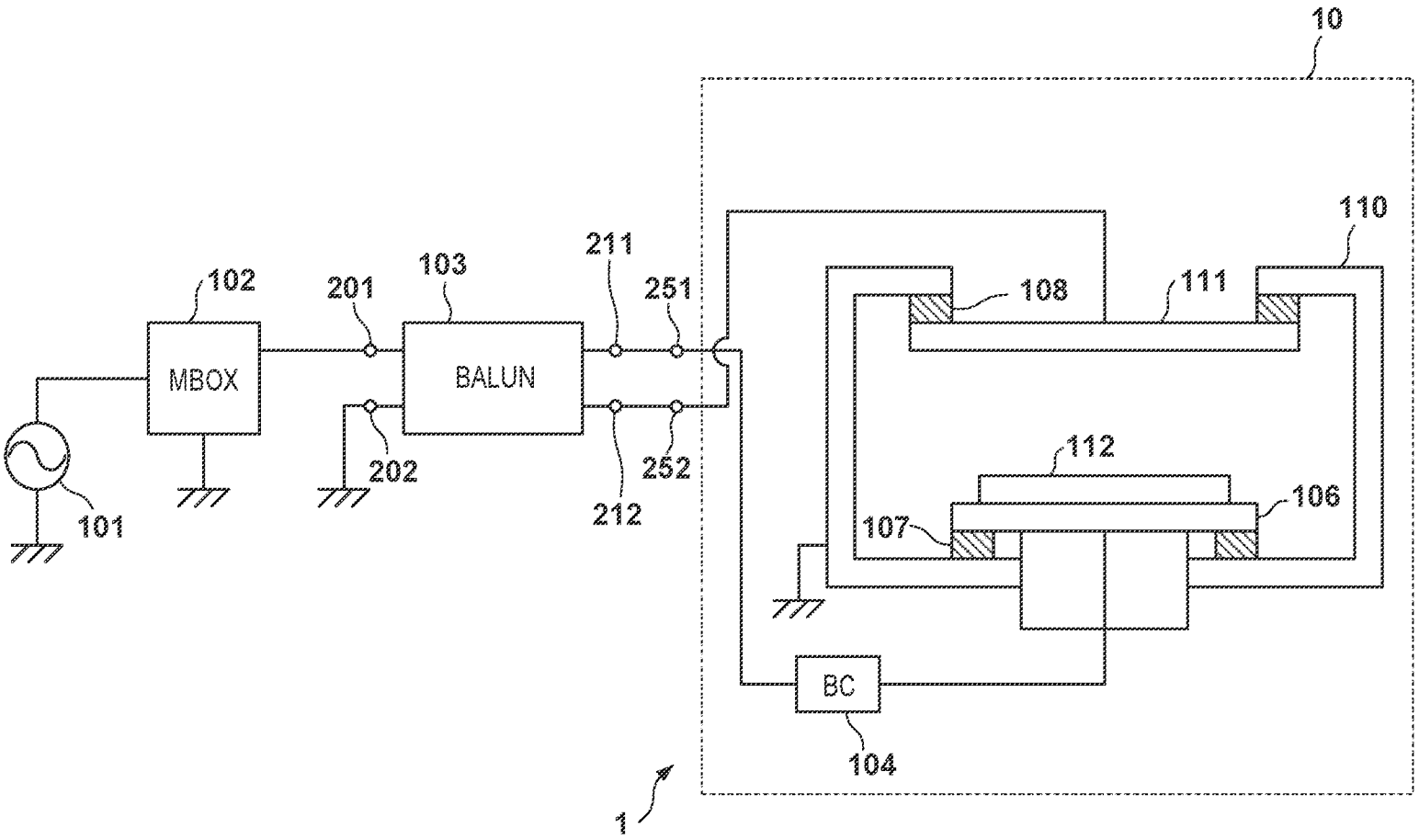
FIG. 8 is a circuit diagram schematically showing the arrangement of a plasma processing apparatus 1 according to the second embodiment of the present invention.

FIG. 8 schematically shows the arrangement of a plasma processing apparatus 1 according to the second embodiment of the present invention. The plasma processing apparatus 1 according to the second embodiment can operate as an etching apparatus that etches a substrate 112. In the second embodiment, a first electrode 106 serves as a cathode, and holds the substrate 112. In the second embodiment, a second electrode 111 serves as an anode. In the plasma processing apparatus 1 according to the second embodiment, the first electrode 106 and a first balanced terminal 211 are electrically connected via a blocking capacitor 104. In other words, in the plasma processing apparatus 1 according to the second embodiment, the blocking capacitor 104 is arranged in an electrical connection path between the first electrode 106 and the first balanced terminal 211.

Figure 9:
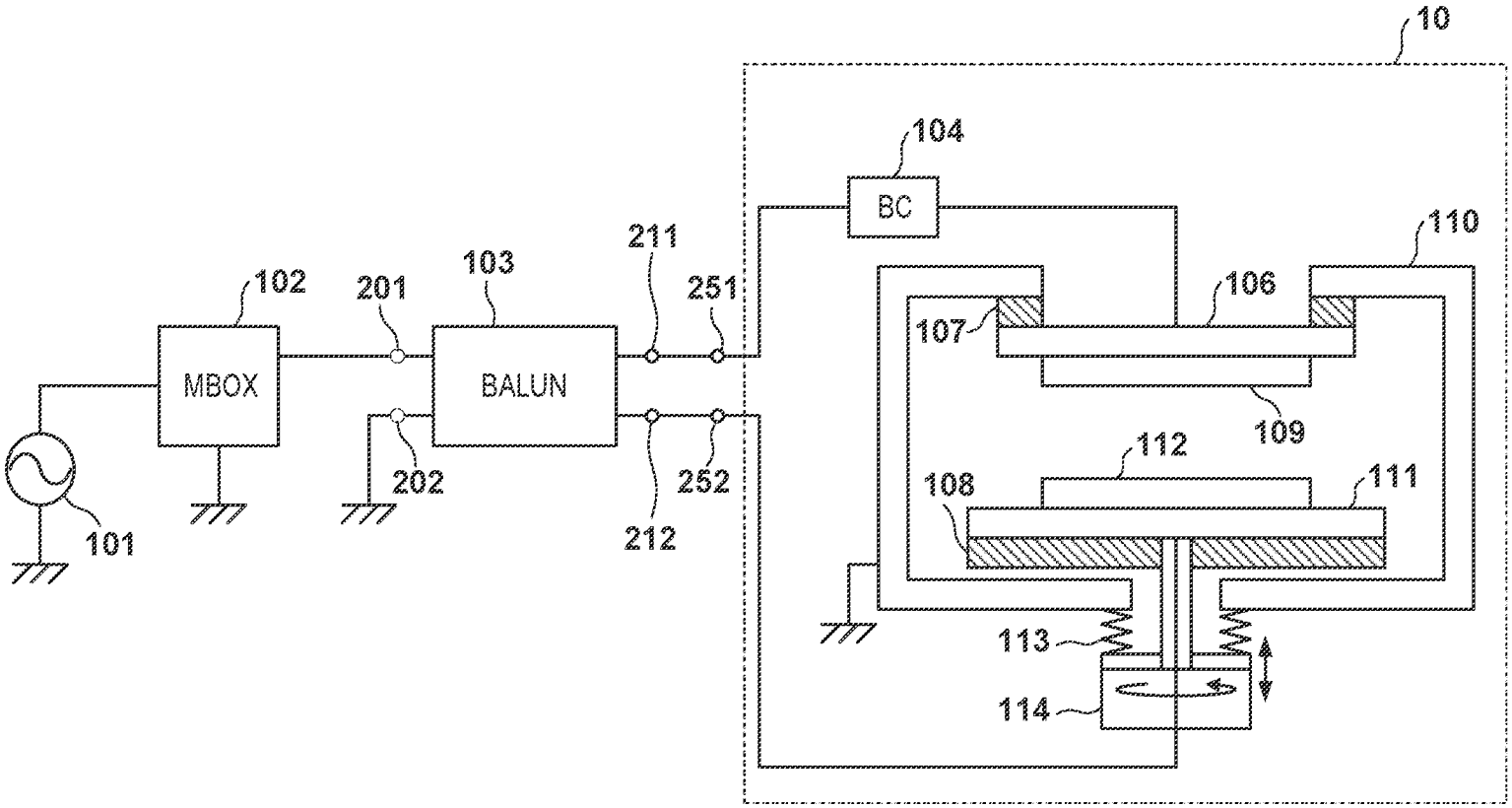
FIG. 9 is a circuit diagram schematically showing the arrangement of a plasma processing apparatus 1 according to the third embodiment of the present invention.

FIG. 9 schematically shows the arrangement of a plasma processing apparatus 1 according to the third embodiment of the present invention. The plasma processing apparatus 1 according to the third embodiment is a modification of the plasma processing apparatus 1 according to the first embodiment, and further includes at least one of a mechanism for vertically moving a second electrode 111 and a mechanism for rotating the second electrode 111. In the example shown in FIG. 9, the plasma processing apparatus 1 includes a driving mechanism 114 having both the mechanism for vertically moving the second electrode 111 and the mechanism for rotating the second electrode 111. A bellows 113 forming a vacuum partition can be provided between a vacuum container 110 and the driving mechanism 114.

Similarly, the plasma processing apparatus 1 according to the second embodiment can further include at least one of a mechanism for vertically moving the first electrode 106 and a mechanism for rotating the first electrode 106.

Figure 10:
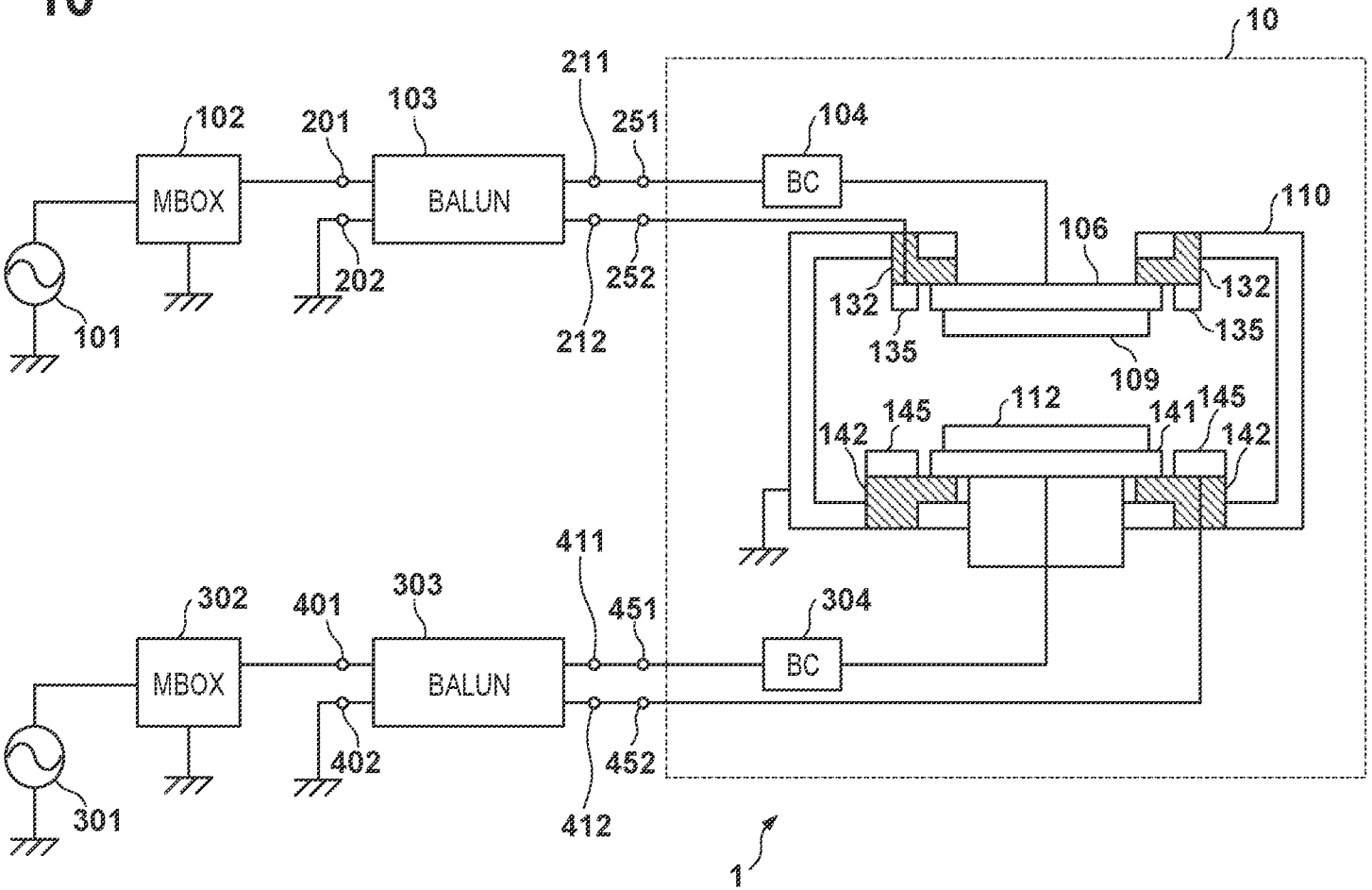
FIG. 10 is a circuit diagram schematically showing the arrangement of a plasma processing apparatus 1 according to the fourth embodiment of the present invention.

FIG. 10 schematically shows the arrangement of a plasma processing apparatus 1 according to the fourth embodiment of the present invention. Items which are not referred to as the plasma processing apparatus 1 according to the fourth embodiment can comply with the first to third embodiments. The plasma processing apparatus 1 includes a first balun 103, a second balun 303, a vacuum container 110, a first electrode 106, and a second electrode 135 constituting the first pair, and a first electrode 141 and a second electrode 145 constituting the second pair. Alternatively, it may be understood that the plasma processing apparatus 1 includes the first balun 103, the second balun 303, and a main body 10, and the main body 10 includes the vacuum container 110, the first electrode 106 and the second electrode 135 constituting the first pair, and the first electrode 141 and the second electrode 145 constituting the second pair. The main body 10 includes a first terminal 251, a second terminal 252, a third terminal 451, and a fourth terminal 452.

The first balun 103 includes a first unbalanced terminal 201, a second unbalanced terminal 202, a first balanced terminal 211, and a second balanced terminal 212. An unbalanced circuit is connected to the first unbalanced terminal 201 and the second unbalanced terminal 202 of the first balun 103, and a balanced circuit is connected to the first balanced terminal 211 and the second balanced terminal 212 of the first balun 103. The second balun 303 can have an arrangement similar to that of the first balun 103. The second balun 303 includes a first unbalanced terminal 401, a second unbalanced terminal 402, a first balanced terminal 411, and a second balanced terminal 412. An unbalanced circuit is connected to the first unbalanced terminal 401 and the second unbalanced terminal 402 of the second balun 303, and a balanced circuit is connected to the first balanced terminal 411 and the second balanced terminal 412 of the second balun 303. The vacuum container 110 is grounded.

The first electrode 106 of the first pair holds a target 109. The target 109 can be, for example, an insulator material or a conductor material. The second electrode 135 of the first pair is arranged around the first electrode 106. The first electrode 106 of the first pair is electrically connected to the first balanced terminal 211 of the first balun 103, and the second electrode 135 of the first pair is electrically connected to the second balanced terminal 212 of the first balun 103. The first electrode 141 of the second pair holds a substrate 112. The second electrode 145 of the second pair is arranged around the first electrode 141. The first electrode 141 of the second pair is electrically connected to the first balanced terminal 411 of the second balun 303, and the second electrode 145 of the second pair is electrically connected to the second balanced terminal 412 of the second balun 303.

The above arrangement can be understood as an arrangement in which the first electrode 106 of the first pair is electrically connected to the first terminal 251, the second electrode 135 of the first pair is electrically connected to the second terminal 252, the first terminal 251 is electrically connected to the first balanced terminal 211 of the first balun 103, and the second terminal 252 is electrically connected to the second balanced terminal 212 of the first balun 103. The above arrangement can be understood as an arrangement in which the first electrode 141 of the second pair is electrically connected to the third terminal 451, the second electrode 145 of the second pair is electrically connected to the fourth terminal 452, the third terminal 451 is electrically connected to the first balanced terminal 411 of the second balun 303, and the fourth terminal 452 is electrically connected to the second balanced terminal 412 of the second balun 303.

The first electrode 106 of the first pair and the first balanced terminal 211 (first terminal 251) of the first balun 103 can electrically be connected via a blocking capacitor 104. The blocking capacitor 104 blocks a DC current between the first balanced terminal 211 of the first balun 103 and the first electrode 106 of the first pair (or between the first balanced terminal 211 and the second balanced terminal 212 of the first balun 103). Instead of providing the blocking capacitor 104, a first impedance matching circuit 102 may be configured to block a DC current flowing between the first unbalanced terminal 201 and the second unbalanced terminal 202 of the first balun 103. The first electrode 106 and the second electrode 135 of the first pair can be supported by the vacuum container 110 via an insulator 132.

The first electrode 141 of the second pair and the first balanced terminal 411 (third terminal 451) of the second balun 303 can electrically be connected via a blocking capacitor 304. The blocking capacitor 304 blocks a DC current between the first balanced terminal 411 of the second balun 303 and the first electrode 141 of the second pair (or between the first balanced terminal 411 and the second balanced terminal 412 of the second balun 303). Instead of providing the blocking capacitor 304, a second impedance matching circuit 302 may be configured to block a DC current flowing between the first unbalanced terminal 201 and the second unbalanced terminal 202 of the second balun 303. The first electrode 141 and the second electrode 145 of the second pair can be supported by the vacuum container 110 via an insulator 142.

The plasma processing apparatus 1 can include a first high-frequency power supply 101, and the first impedance matching circuit 102 arranged between the first high-frequency power supply 101 and the first balun 103. The first high-frequency power supply 101 supplies a high frequency between the first unbalanced terminal 201 and the second unbalanced terminal 202 of the first balun 103 via the first impedance matching circuit 102. In other words, the first high-frequency power supply 101 supplies a high frequency between the first electrode 106 and the second electrode 135 via the first impedance matching circuit 102, the first balun 103, and the blocking capacitor 104. Alternatively, the first high-frequency power supply 101 supplies a high frequency between the first terminal 251 and the second terminal 252 of the main body 10 via the first impedance matching circuit 102 and the first balun 103. The first balun 103 and the first electrode 106 and the second electrode 135 of the first pair form the first high-frequency supply unit that supplies a high frequency to the internal space of the vacuum container 110.

The plasma processing apparatus 1 can include a second high-frequency power supply 301, and the second impedance matching circuit 302 arranged between the second high-frequency power supply 301 and the second balun 303. The second high-frequency power supply 301 supplies a high frequency between the first unbalanced terminal 401 and the second unbalanced terminal 402 of the second balun 303 via the second impedance matching circuit 302. In other words, the second high-frequency power supply 301 supplies a high frequency between the first electrode 141 and the second electrode 145 of the second pair via the second impedance matching circuit 302, the second balun 303, and the blocking capacitor 304. Alternatively, the second high-frequency power supply 301 supplies a high frequency between the third terminal 451 and the fourth terminal 452 of the main body 10 via the second impedance matching circuit 302 and the second balun 303. The second balun 303 and the first electrode 141 and the second electrode 145 of the second pair form the second high-frequency supply unit that supplies a high frequency to the internal space of the vacuum container 110.

Let Rp1−jXp1 be an impedance when viewing the side of the first electrode 106 and the second electrode 135 of the first pair (the side of the main body 10) from the side of the first balanced terminal 211 and the second balanced terminal 212 of the first balun 103 in a state in which plasma is generated in the internal space of the vacuum container 110 by supplying a high frequency from the first high-frequency power supply 101. Let X1 be the reactance component (inductance component) of the impedance of a first coil 221 of the first balun 103. In this definition, when $1.5 \leq X1/Rp1 \leq 5000$ is satisfied, the potential of the plasma formed in the internal space of the vacuum container 110 can be stabilized.

In addition, let Rp2−jXp2 be an impedance when viewing the side of the first electrode 141 and the second electrode 145 of the second pair (the side of the main body 10) from the side of the first balanced terminal 411 and the second balanced terminal 412 of the second balun 303 in a state in which plasma is generated in the internal space of the vacuum container 110 by supplying a high frequency from the second high-frequency power supply 301. Let X2 be the reactance component (inductance component) of the impedance of a first coil 221 of the second balun 303. In this definition, when $1.5 \leq X2/Rp2 \leq 5000$ is satisfied, the potential of the plasma formed in the internal space of the vacuum container 110 can be stabilized.

Figure 11:
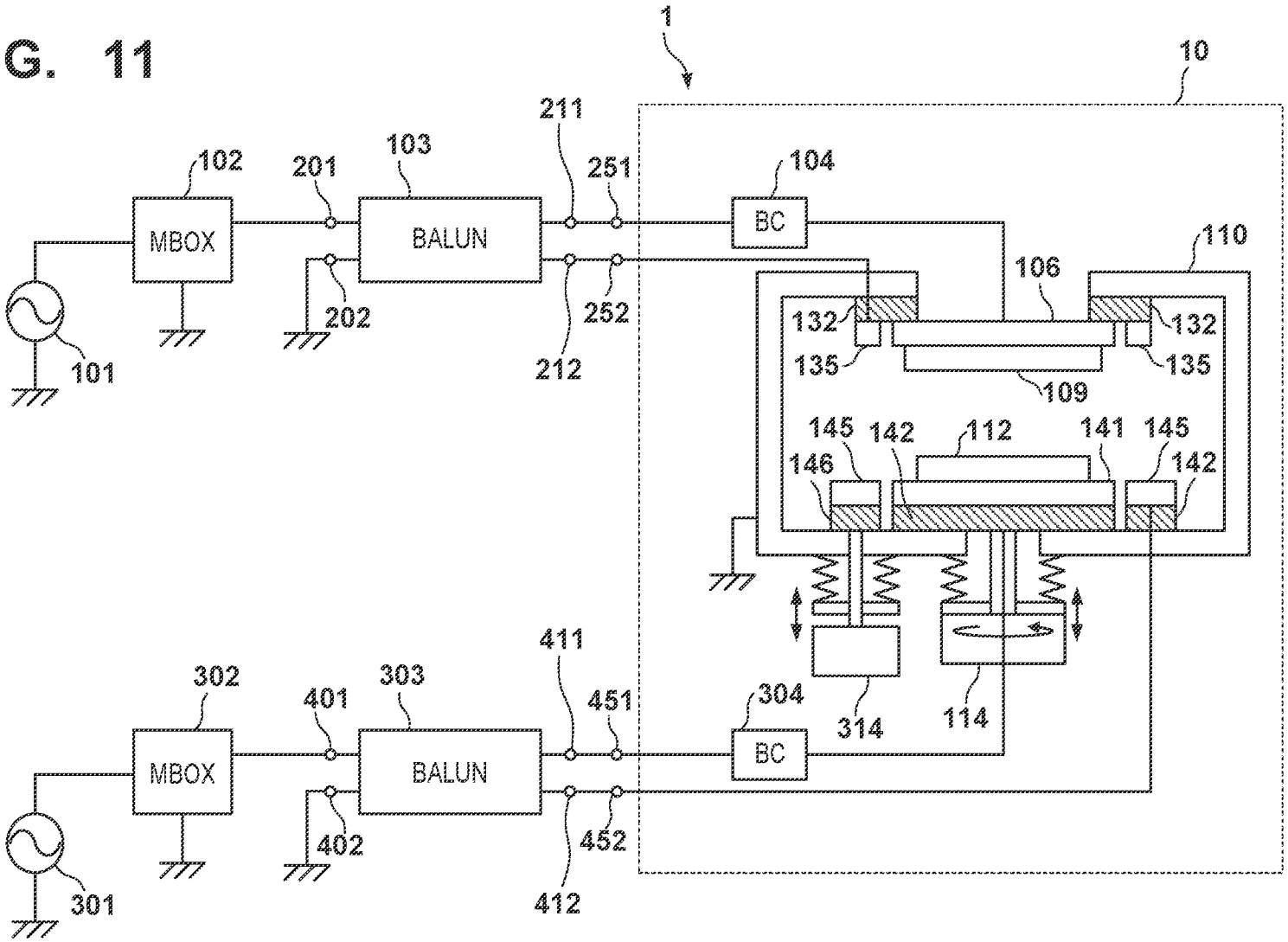
FIG. 11 is a circuit diagram schematically showing the arrangement of a plasma processing apparatus 1 according to the fifth embodiment of the present invention.

FIG. 11 schematically shows the arrangement of a plasma processing apparatus 1 according to the fifth embodiment of the present invention. The apparatus 1 according to the fifth embodiment has an arrangement obtained by adding driving mechanisms 114 and 314 to the plasma processing apparatus 1 according to the fourth embodiment. The driving mechanism 114 can include at least one of a mechanism for vertically moving a first electrode 141 and a mechanism for rotating the first electrode 141. The driving mechanism 314 can include a mechanism for vertically moving a second electrode 145.

Figure 12:
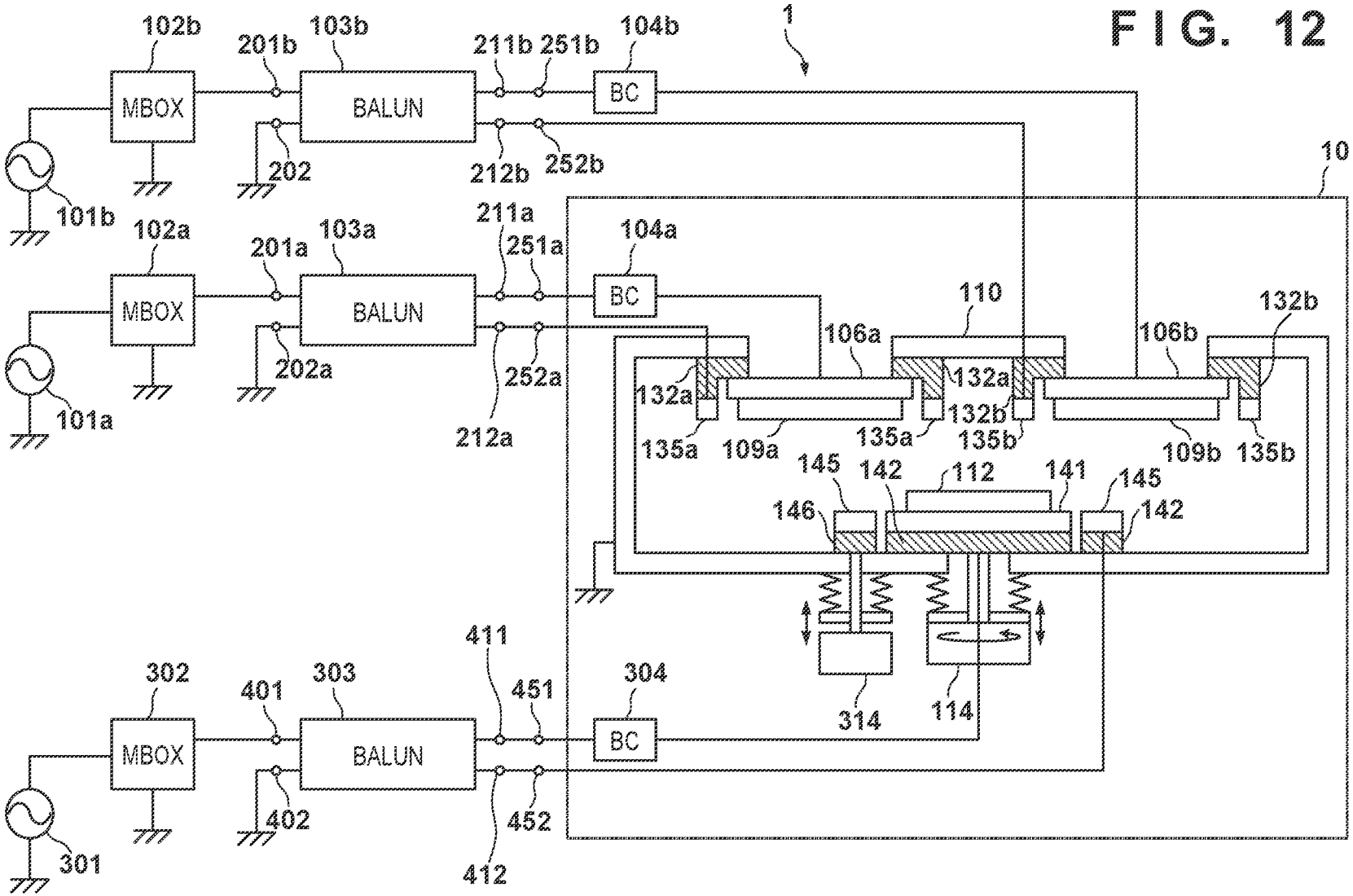
FIG. 12 is a circuit diagram schematically showing the arrangement of a plasma processing apparatus 1 according to the sixth embodiment of the present invention.

FIG. 12 schematically shows the arrangement of a plasma processing apparatus 1 according to the sixth embodiment of the present invention. Items which are not referred to as the sixth embodiment can comply with the first to fifth embodiments. The plasma processing apparatus 1 according to the sixth embodiment includes a plurality of first high-frequency supply units and at least one second high-frequency supply unit. One of the plurality of first high-frequency supply units can include a first electrode 106*a*, a second electrode 135*a*, and a first balun 103*a*. Another one of the plurality of first high-frequency supply units can include a first electrode 106*b*, a second electrode 135*b*, and a first balun 103*b*. An example in which the plurality of first high-frequency supply units are formed by two high-frequency supply units will be described. In addition, the two high-frequency supply units and constituent elements associated with them are distinguished from each other using subscripts a and b. Similarly, two targets are distinguished from each other using subscripts a and b.

From another viewpoint, the plasma processing apparatus 1 includes the plurality of first baluns 103*a* and 103*b*, a second balun 303, a vacuum container 110, the first electrode 106*a* and the second electrode 135*a*, the first electrode 106*b* and the second electrode 135*b*, and a first electrode 141 and a second electrode 145. Alternatively, it may be understood that the plasma processing apparatus 1 includes the plurality of first baluns 103*a* and 103*b*, the second balun 303, and a main body 10, and the main body 10 includes the vacuum container 110, the first electrode 106*a* and the second electrode 135*a*, the first electrode 106*b* and the second electrode 135*b*, and the first electrode 141 and the second electrode 145. The main body 10 includes first terminals 251*a* and 251*b*, second terminals 252*a* and 252*b*, a third terminal 451, and a fourth terminal 452.

The first balun 103*a* includes a first unbalanced terminal 201*a*, a second unbalanced terminal 202*a*, a first balanced terminal 211*a*, and a second balanced terminal 212*a*. An unbalanced circuit is connected to the first unbalanced terminal 201*a* and the second unbalanced terminal 202*a* of the first balun 103*a*, and a balanced circuit is connected to the first balanced terminal 211*a* and the second balanced terminal 212*a* of the first balun 103*a*. The first balun 103*b* includes a first unbalanced terminal 201*b*, a second unbalanced terminal 202*b*, a first balanced terminal 211*b*, and a second balanced terminal 212*b*. An unbalanced circuit is connected to the first unbalanced terminal 201*b* and the second unbalanced terminal 202*b* of the first balun 103*b*, and a balanced circuit is connected to the first balanced terminal 211*b* and the second balanced terminal 212*b* of the first balun 103*b*.

The second balun 303 can have an arrangement similar to that of the first balun 103*a* or 103*b*. The second balun 303 includes a first unbalanced terminal 401, a second unbalanced terminal 402, a first balanced terminal 411, and a second balanced terminal 412. An unbalanced circuit is connected to the first unbalanced terminal 401 and the second unbalanced terminal 402 of the second balun 303, and a balanced circuit is connected to the first balanced terminal 411 and the second balanced terminal 412 of the second balun 303. The vacuum container 110 is grounded.

The first electrodes 106*a* and 106*b* hold targets 109*a* and 109*b*, respectively. Each of the targets 109*a* and 109*b* can be, for example, an insulator material or a conductor material. The second electrodes 135*a* and 135*b* are arranged around the first electrodes 106*a* and 106*b*, respectively. The first electrodes 106*a* and 106*b* are electrically connected to the first balanced terminals 211*a* and 211*b* of the first baluns 103*a* and 103*b*, respectively, and the second electrodes 135*a* and 135*b* are electrically connected to the second balanced terminals 212*a* and 212*b* of the first baluns 103*a* and 103*b*, respectively.

The first electrode 141 holds a substrate 112. The second electrode 145 is arranged around the first electrode 141. The first electrode 141 is electrically connected to the first balanced terminal 411 of the second balun 303, and the second electrode 145 is electrically connected to the second balanced terminal 412 of the second balun 303.

The above arrangement can be understood as an arrangement in which the first electrodes 106*a* and 106*b* are electrically connected to the first terminals 251*a* and 251*b*, respectively, the second electrodes 135*a* and 135*b* are electrically connected to the second terminals 252*a* and 252*b*, respectively, the first terminals 251*a* and 251*b* are electrically connected to the first balanced terminals 211*a* and 111*b* of the first baluns 103*a* and 103*b*, respectively, and the second terminals 252*a* and 252*b* are electrically be connected to the second balanced terminals 212*a* and 212*b* of the first baluns 103*a* and 103*b*, respectively. The above arrangement can be understood as an arrangement in which the first electrode 141 is electrically connected to the third terminal 451, the second electrode 145 is electrically connected to the fourth terminal 452, the third terminal 451 is electrically connected to the first balanced terminal 411 of the second balun 303, and the fourth terminal 452 is electrically connected to the second balanced terminal 412 of the second balun 303.

The first electrodes 106*a* and 106*b* and the first balanced terminals 211*a* and 211*b* (first terminals 251*a* and 251*b*) of the first baluns 103*a* and 103*b* can electrically be connected via blocking capacitors 104*a* and 104*b*, respectively. The blocking capacitors 104*a* and 104*b* block DC currents between the first electrodes 106*a* and 106*b* and the first balanced terminals 211*a* and 211*b* of the first baluns 103*a* and 103*b* (or between the first balanced terminals 211*a* and 211*b* and the second balanced terminals 212*a* and 212*b* of the first baluns 103*a* and 103*b*), respectively. Instead of providing the blocking capacitors 104*a* and 104*b*, first impedance matching circuits 102*a* and 102*b* may be configured to block DC currents flowing between the first unbalanced terminals 201*a* and 201*b* and the second unbalanced terminals 202*a* and 202*b* of the first baluns 103*a* and 103*b*, respectively. Alternatively, the blocking capacitors 104*a* and 104*b* may be arranged between the second electrodes 135*a* and 135*b* and the second balanced terminals 212*a* and 212*b* (second terminals 252*a* and 252*b*) of the first baluns 103*a* and 103*b*, respectively. The first electrodes 106*a* and 106*b* and the second electrodes 135*a* and 135*b* can be supported by the vacuum container 110 via insulators 132*a* and 132*b*, respectively.

The first electrode 141 and the first balanced terminal 411 (third terminal 451) of the second balun 303 can electrically be connected via a blocking capacitor 304. The blocking capacitor 304 blocks a DC current between the first electrode 141 and the first balanced terminal 411 of the second balun 303 (or between the first balanced terminal 411 and the second balanced terminal 412 of the second balun 303). Instead of providing the blocking capacitor 304, a second impedance matching circuit 302 may be configured to block a DC current flowing between the first unbalanced terminal 201 and the second unbalanced terminal 202 of the second balun 303. Alternatively, the blocking capacitor 304 may be arranged between the second electrode 145 and the second balanced terminal 412 (fourth terminal 452) of the second balun 303. The first electrode 141 and the second electrode 145 can be supported by the vacuum container 110 via an insulator 142.

The plasma processing apparatus 1 can include a plurality of first high-frequency power supplies 101*a* and 101*b*, and the first impedance matching circuits 102*a* and 102*b* respectively arranged between the plurality of first high-frequency power supplies 101*a* and 101*b* and the plurality of first baluns 103*a* and 103*b*. The first high-frequency power supplies 101*a* and 101*b* supply high frequencies between the first unbalanced terminals 201*a* and 201*b* and the second unbalanced terminals 202*a* and 202*b* of the first baluns 103*a* and 103*b* via the first impedance matching circuits 102*a* and 102*b*, respectively. In other words, the first high-frequency power supplies 101*a* and 101*b* supply high frequencies between the first electrodes 106*a* and 106*b* and the second electrodes 135*a* and 135*b* via the first impedance matching circuits 102*a* and 102*b*, the first baluns 103*a* and 103*b*, and the blocking capacitors 104*a* and 104*b*, respectively. Alternatively, the first high-frequency power supplies 101*a* and 101*b* supply high frequencies between the first terminals 251*a* and 251*b* and the second terminals 252*a* and 252*b* of the main body 10 via the first impedance matching circuits 102*a* and 102*b* and the first baluns 103*a* and 103*b*.

The plasma processing apparatus 1 can include a second high-frequency power supply 301, and the second impedance matching circuit 302 arranged between the second high-frequency power supply 301 and the second balun 303. The second high-frequency power supply 301 supplies a high frequency between the first unbalanced terminal 401 and the second unbalanced terminal 402 of the second balun 303 via the second impedance matching circuit 302. In other words, the second high-frequency power supply 301 supplies a high frequency between the first electrode 141 and the second electrode 145 via the second impedance matching circuit 302, the second balun 303, and the blocking capacitor 304. Alternatively, the second high-frequency power supply 301 supplies a high frequency between the third terminal 451 and the fourth terminal 452 of the main body 10 via the second impedance matching circuit 302 and the second balun 303.

Figure 13:
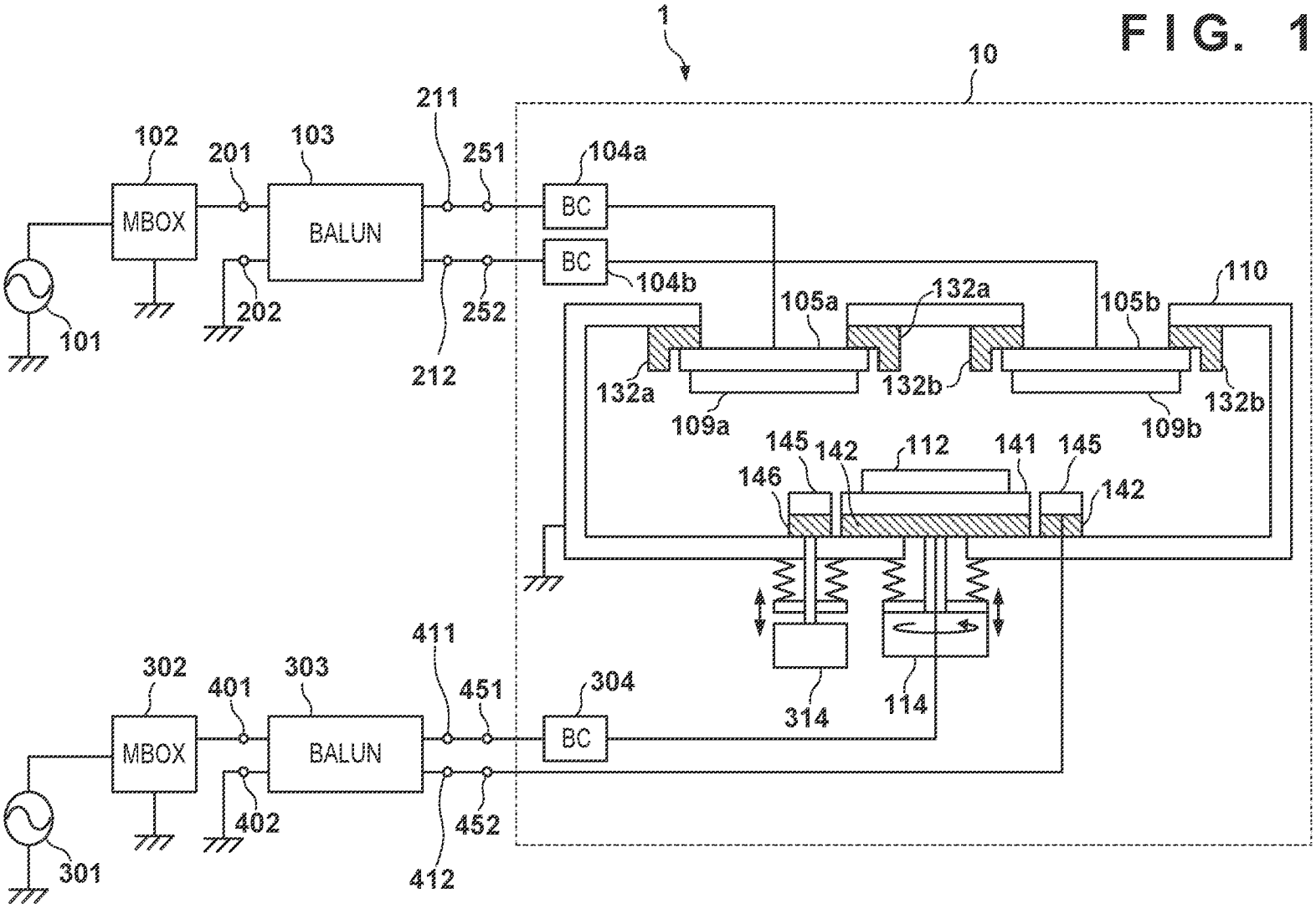
FIG. 13 is a circuit diagram schematically showing the arrangement of a plasma processing apparatus 1 according to the seventh embodiment of the present invention.

FIG. 13 schematically shows the arrangement of a plasma processing apparatus 1 according to the seventh embodiment of the present invention. Items which are not referred to as the sputtering apparatus 1 according to the seventh embodiment can comply with the first to sixth embodiments. The plasma processing apparatus 1 includes a first balun 103, a second balun 303, a vacuum container 110, a first electrode 105*a* and a second electrode 105*b* constituting the first pair, and a first electrode 141 and a second electrode 145 constituting the second pair. Alternatively, it may be understood that the plasma processing apparatus 1 includes the first balun 103, the second balun 303, and a main body 10, and the main body 10 includes the vacuum container 110, the first electrode 105*a* and the second electrode 105*b* constituting the first pair, and the first electrode 141 and the second electrode 145 constituting the second pair. The main body 10 includes a first terminal 251, a second terminal 252, a third terminal 451 and a fourth terminal 452.

The first balun 103 includes a first unbalanced terminal 201, a second unbalanced terminal 202, a first balanced terminal 211, and a second balanced terminal 212. An unbalanced circuit is connected to the first unbalanced terminal 201 and the second unbalanced terminal 202 of the first balun 103, and a balanced circuit is connected to the first balanced terminal 211 and the second balanced terminal 212 of the first balun 103. The second balun 303 can have an arrangement similar to that of the first balun 103. The second balun 303 includes a first unbalanced terminal 401, a second unbalanced terminal 402, a first balanced terminal 411, and a second balanced terminal 412. An unbalanced circuit is connected to the first unbalanced terminal 401 and the second unbalanced terminal 402 of the second balun 303, and a balanced circuit is connected to the first balanced terminal 411 and the second balanced terminal 412 of the second balun 303. The vacuum container 110 is grounded.

The first electrode 105*a* of the first pair holds a first target 109*a*, and opposes a space on the side of a substrate 112 via the first target 109*a*. The second electrode 105*b* of the first pair is arranged adjacent to the first electrode 105*a*, holds a second target 109*b*, and opposes the space on the side of the substrate 112 via the second target 109*b*. Each of the targets 109*a* and 109*b* can be, for example, an insulator material or a conductor material. The first electrode 105*a* of the first pair is electrically connected to the first balanced terminal 211 of the first balun 103, and the second electrode 105*b* of the first pair is electrically connected to the second balanced terminal 212 of the first balun 103.

The first electrode 141 of the second pair holds the substrate 112. The second electrode 145 of the second pair is arranged around the first electrode 141. The first electrode 141 of the second pair is electrically connected to the first balanced terminal 411 of the second balun 303, and the second electrode 145 of the second pair is electrically connected to the second balanced terminal 412 of the second balun 303.

The above arrangement can be understood as an arrangement in which the first electrode 105*a* of the first pair is electrically connected to the first terminal 251, the second electrode 105*b* of the first pair is electrically connected to the second terminal 252, the first terminal 251 is electrically connected to the first balanced terminal 211 of the first balun 103, and the second terminal 252 is connected to the second balanced terminal 212 of the first balun 103. Furthermore, the above arrangement can be understood as an arrangement in which the first electrode 141 of the second pair is electrically connected to the third terminal 451, the second electrode 145 of the second pair is electrically connected to the fourth terminal 452, the third terminal 451 is electrically connected to the first balanced terminal 411 of the second balun 303, and the fourth terminal 452 is connected to the second balanced terminal 412 of the second balun 303.

The first electrode 105*a* of the first pair and the first balanced terminal 211 (first terminal 251) of the first balun 103 can electrically be connected via a blocking capacitor 104*a*. The blocking capacitor 104*a* blocks a DC current between the first balanced terminal 211 of the first balun 103 and the first electrode 105*a* of the first pair (or between the first balanced terminal 211 and the second balanced terminal 212 of the first balun 103). The second electrode 105*b* of the first pair and the second balanced terminal 212 (second terminal 252) of the first balun 103 can electrically be connected via a blocking capacitor 104*b*. The blocking capacitor 104*b* blocks a DC current between the second balanced terminal 212 of the first balun 103 and the second electrode 105*b* of the first pair (or between the first balanced terminal 211 and the second balanced terminal 212 of the first balun 103). The first electrode 105*a* and the second electrode 105*b* of the first pair can be supported by the vacuum container 110 via insulators 132*a* and 132*b*, respectively.

The first electrode 141 of the second pair and the first balanced terminal 411 (third terminal 451) of the second balun 303 can electrically be connected via a blocking capacitor 304. The blocking capacitor 304 blocks a DC current between the first balanced terminal 411 of the second balun 303 and the first electrode 141 of the second pair (or between the first balanced terminal 411 and the second balanced terminal 412 of the second balun 303). Instead of providing the blocking capacitor 304, a second impedance matching circuit 302 may be configured to block a DC current flowing between the first unbalanced terminal 401 and the second unbalanced terminal 402 of the second balun 303. The first electrode 141 and the second electrode 145 of the second pair can be supported by the vacuum container 110 via insulators 142 and 146, respectively.

The plasma processing apparatus 1 can include a first high-frequency power supply 101, and a first impedance matching circuit 102 arranged between the first high-frequency power supply 101 and the first balun 103. The first high-frequency power supply 101 supplies a high frequency between the first electrode 105*a* and the second electrode 105*b* via the first impedance matching circuit 102, the first balun 103, and the blocking capacitors 104*a* and 104*b*. Alternatively, the first high-frequency power supply 101 supplies a high frequency between the first terminal 251 and the second terminal 252 of the main body 10 via the first impedance matching circuit 102 and the first balun 103. The first balun 103 and the first electrode 105*a* and the second electrode 105*b* of the first pair form the first high-frequency supply unit that supplies a high frequency to the internal space of the vacuum container 110.

The plasma processing apparatus 1 can include a second high-frequency power supply 301, and the second impedance matching circuit 302 arranged between the second high-frequency power supply 301 and the second balun 303. The second high-frequency power supply 301 supplies a high frequency between the first unbalanced terminal 401 and the second unbalanced terminal 402 of the second balun 303 via the second impedance matching circuit 302. The second high-frequency power supply 301 supplies a high frequency between the first electrode 141 and the second electrode 145 of the second pair via the second impedance matching circuit 302, the second balun 303, and the blocking capacitor 304. Alternatively, the second high-frequency power supply 301 supplies a high frequency between the third terminal 451 and the fourth terminal 452 of the main body 10 via the second impedance matching circuit 302 and the second balun 303. The second balun 303 and the first electrode 141 and the second electrode 145 of the second pair form the second high-frequency supply unit that supplies a high frequency to the internal space of the vacuum container 110.

Let Rp1−jXp1 be an impedance when viewing the side of the first electrode 105*a* and the second electrode 105*b* of the first pair (the side of the main body 10) from the side of the first balanced terminal 211 and the second balanced terminal 212 of the first balun 103 in a state in which plasma is generated in the internal space of the vacuum container 110 by supplying a high frequency from the first high-frequency power supply 101. Let X1 be the reactance component (inductance component) of the impedance of a first coil 221 of the first balun 103. In this definition, when $1.5 \leq X1/Rp1 \leq 5000$ is satisfied, the potential of the plasma formed in the internal space of the vacuum container 110 can be stabilized.

In addition, let Rp2−jXp2 be an impedance when viewing the side of a first electrode 127 and a second electrode 130 of the second pair (the side of the main body 10) from the side of the first balanced terminal 411 and the second balanced terminal 412 of the second balun 303 in a state in which plasma is generated in the internal space of the vacuum container 110 by supplying a high frequency from the second high-frequency power supply 302. Let X2 be the reactance component (inductance component) of the impedance of a first coil 221 of the second balun 303. In this definition, when $1.5 \leq X2/Rp2 \leq 5000$ is satisfied, the potential of the plasma formed in the internal space of the vacuum container 110 can be stabilized.

The sputtering apparatus 1 according to the seventh embodiment can further include at least one of a mechanism for vertically moving the first electrode 141 constituting the second pair and a mechanism for rotating the first electrode 141 constituting the second pair. In the example shown in FIG. 13, the plasma processing apparatus 1 includes a driving mechanism 114 having both the mechanism for vertically moving the first electrode 141 and the mechanism for rotating the first electrode 141. Furthermore, in the example shown in FIG. 13, the plasma processing apparatus 1 includes a driving mechanism 314 for vertically moving the second electrode constituting the second pair. Bellows forming vacuum partitions can be provided between a vacuum container 113 and the driving mechanisms 114 and 314.

The function of the first balun 103 in the plasma processing apparatus 1 according to the seventh embodiment shown in FIG. 13 will be described with reference to FIG. 14. Let I1 be a current flowing through the first unbalanced terminal 201, I2 be a current flowing through the first balanced terminal 211, I2' be a current flowing through the second unbalanced terminal 202, and I3 be a current, of the current I2, flowing to ground. When I3=0, that is, no current flows to ground on the balanced circuit side, the isolation performance of the balanced circuit with respect to ground is highest. When I3=I2, that is, all the current I2 flowing through the first balanced terminal 211 flows to ground, the isolation performance of the balanced circuit with respect to ground is lowest. Similar to the first to fifth embodiments, an index ISO representing the degree of the isolation performance is given by:

$$ISO[\text{dB}]=20\log(I3/I2')$$

Under this definition, as the absolute value of the index ISO is larger, the isolation performance is higher.

Figure 14:
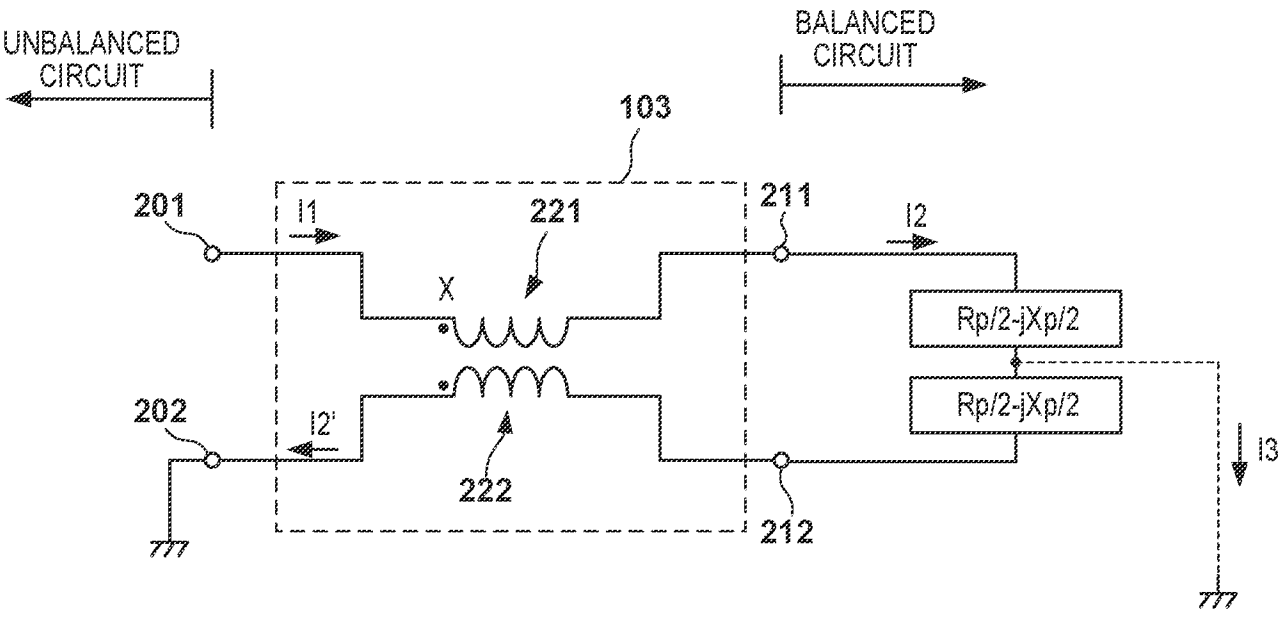
FIG. 14 is a circuit diagram for explaining the function of a balun according to the seventh embodiment.

In FIG. 14, Rp−jXp (=Rp/2−jXp/2+Rp/2−jXp/2) represents an impedance (including the reactances of the blocking capacitors 104*a* and 104*b*) when viewing the side of the first electrode 105*a* and the second electrode 105*b* (the side of the main body 10) from the side of the first balanced terminal 211 and the second balanced terminal 212 in a state in which plasma is generated in the internal space of the vacuum container 110. Rp represents a resistance component, and −Xp represents a reactance component. Furthermore, in FIG. 14, X represents the reactance component (inductance component) of the impedance of the first coil 221 of the balun 103. ISO has a correlation with X/Rp.

FIG. 4 referred to in the description of the first embodiment exemplifies the relationship among the currents I1 (=I2), I2', and I3, ISO, and α(=X/Rp). The relationship shown in FIG. 4 also holds in the seventh embodiment. The present inventor found that in the seventh embodiment as well, when $1.5 \leq X/Rp \leq 5000$ is satisfied, the potential (plasma potential) of plasma formed in the internal space (the space between the first electrode 105*a* and the second electrode 105*b*) of the vacuum container 110 is insensitive to the state of the inner surface of the vacuum container 110. When the plasma potential is insensitive to the state of the inner surface of the vacuum container 110, this indicates that it is possible to stabilize the plasma potential even if the sputtering apparatus 1 is used for a long period. $1.5 \leq X/Rp \leq 5000$ corresponds to $-10.0\ \text{dB} \geq ISO \geq -80\ \text{dB}$.

Figure 15A:
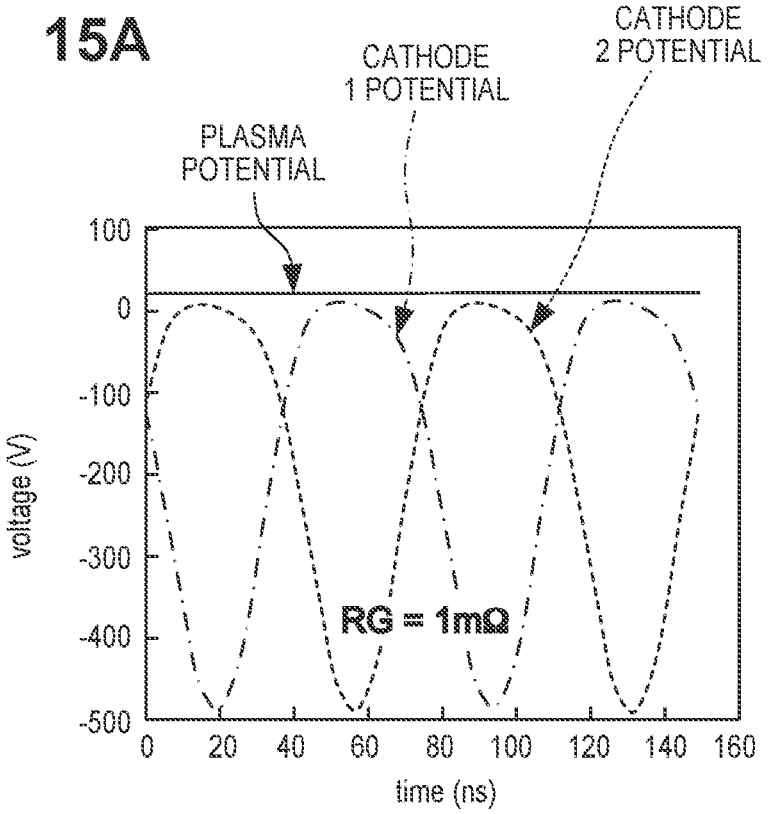
FIG. 15A is a timing chart showing a result of simulating a plasma potential and two cathode potentials when 1.5≤X/Rp≤5000 is satisfied.
Figure 15B:
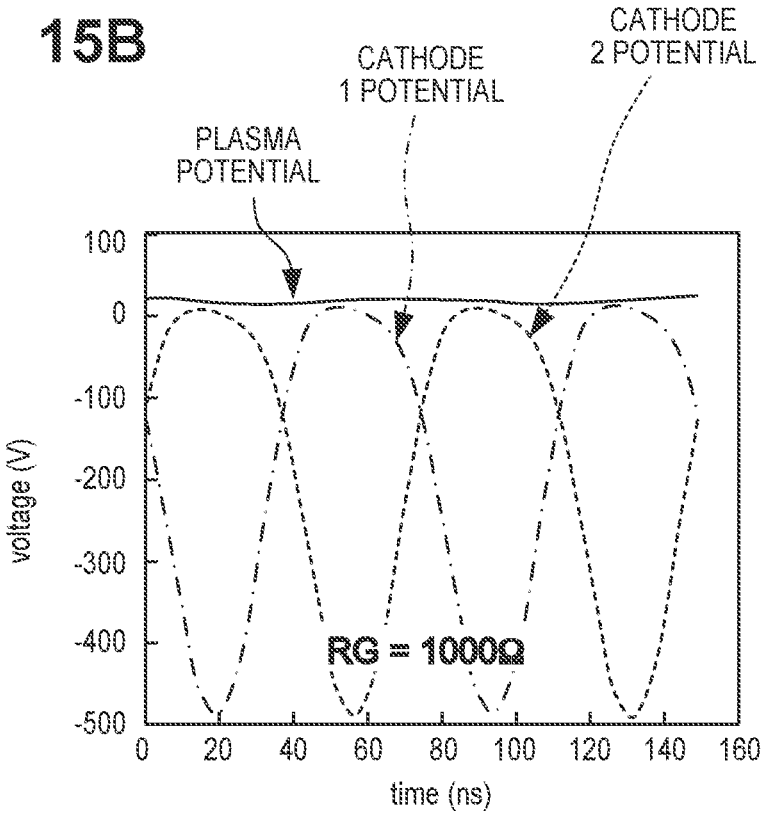
FIG. 15B is a timing chart showing a result of simulating a plasma potential and two cathode potentials when 1.5≤X/Rp≤5000 is satisfied.
Figure 15C:
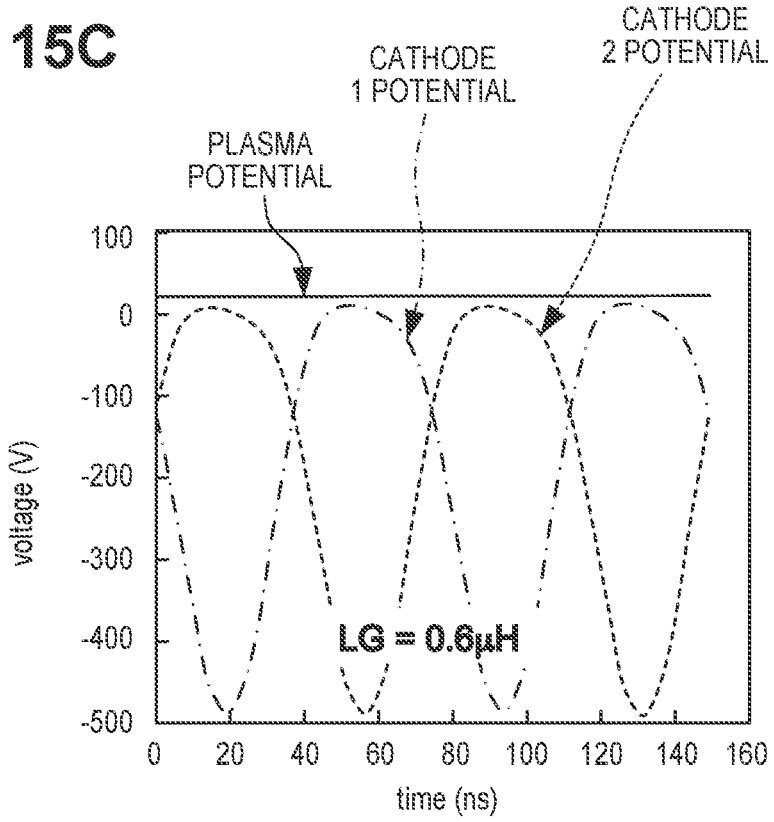
FIG. 15C is a timing chart showing a result of simulating a plasma potential and two cathode potentials when 1.5≤X/Rp≤5000 is satisfied.
Figure 15D:
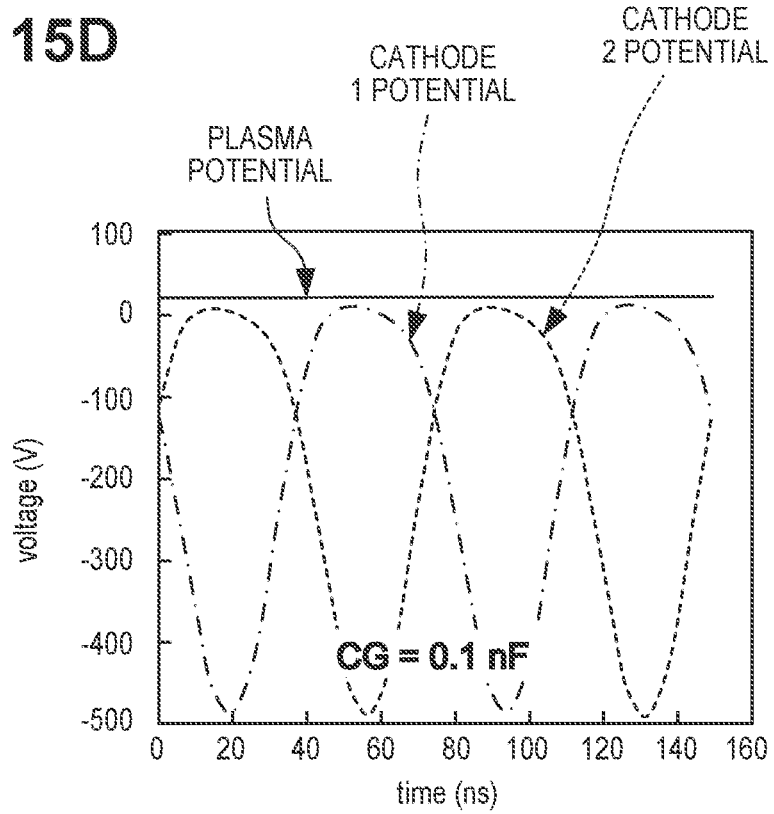
FIG. 15D is a timing chart showing a result of simulating a plasma potential and two cathode potentials when 1.5≤X/Rp≤5000 is satisfied.

FIGS. 15A to 15D each show the plasma potential, the potential (cathode 1 potential) of the first electrode 105*a*, and the potential (cathode 2 potential) of the second electrode 105*b* when $1.5 \leq X/Rp \leq 5000$ is satisfied. FIG. 15A shows the plasma potential, the potential (cathode 1 potential) of the first electrode 105*a*, and the potential (cathode 2 potential) of the second electrode 105*b* in a state in which a resistive film (1 mΩ) is formed on the inner surface of the vacuum container 110. FIG. 15B shows the plasma potential, the potential (cathode 1 potential) of the first electrode 105*a*, and the potential (cathode 2 potential) of the second electrode 105*b* in a state in which a resistive film (1,000Ω) is formed on the inner surface of the vacuum container 110. FIG. 15C shows the plasma potential, the potential (cathode 1 potential) of the first electrode 105*a*, and the potential (cathode 2 potential) of the second electrode 105*b* in a state in which an inductive film (0.6 μH) is formed on the inner surface of the vacuum container 110. FIG. 15D shows the plasma potential, the potential (cathode 1 potential) of the first electrode 105*a*, and the potential (cathode 2 potential)

of the second electrode 105*b* in a state in which a capacitive film (0.1 nF) is formed on the inner surface of the vacuum container 110. With reference to FIGS. 15A to 15D, it is understood that when 1.5≤X/Rp≤5000 is satisfied, the plasma potential is stable in various states of the inner surface of the vacuum container 113.

Figure 16A:
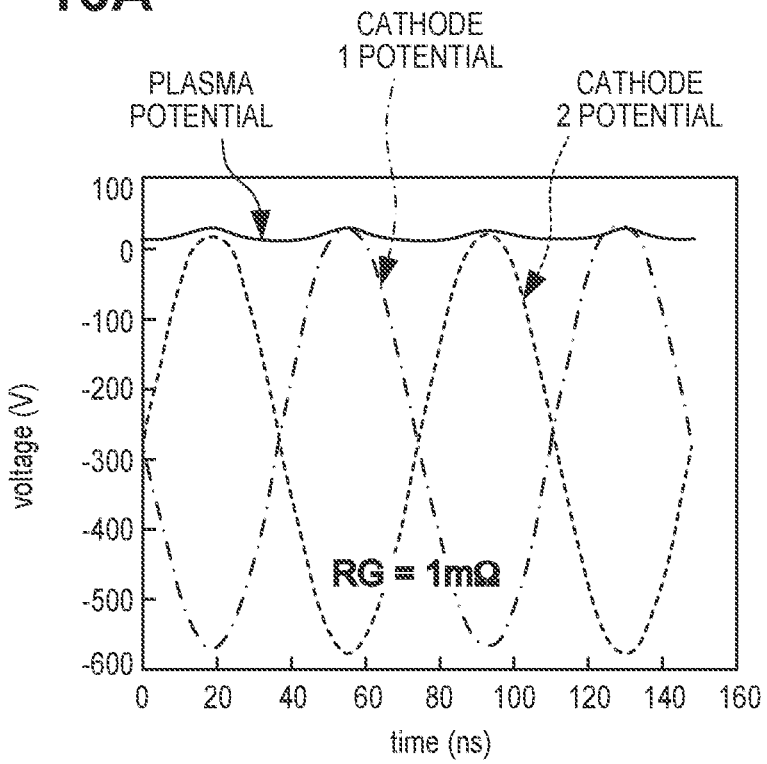
FIG. 16A is a timing chart showing a result of simulating a plasma potential and two cathode potentials when 1.5≤X/Rp≤5000 is not satisfied.
Figure 16B:
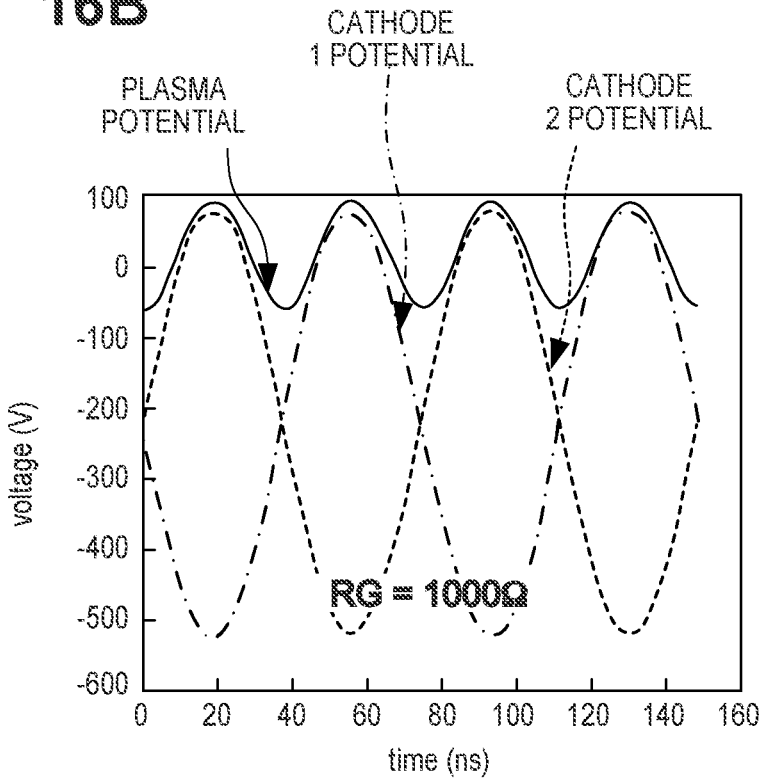
FIG. 16B is a timing chart showing a result of simulating a plasma potential and two cathode potentials when 1.5≤X/Rp≤5000 is not satisfied.
Figure 16C:
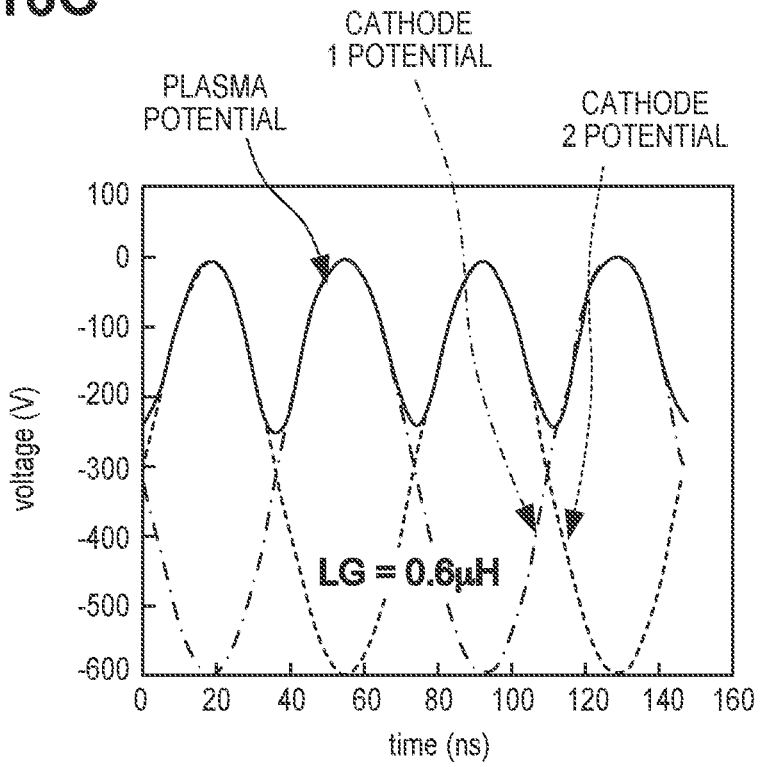
FIG. 16C is a timing chart showing a result of simulating a plasma potential and two cathode potentials when 1.5≤X/Rp≤5000 is not satisfied.
Figure 16D:
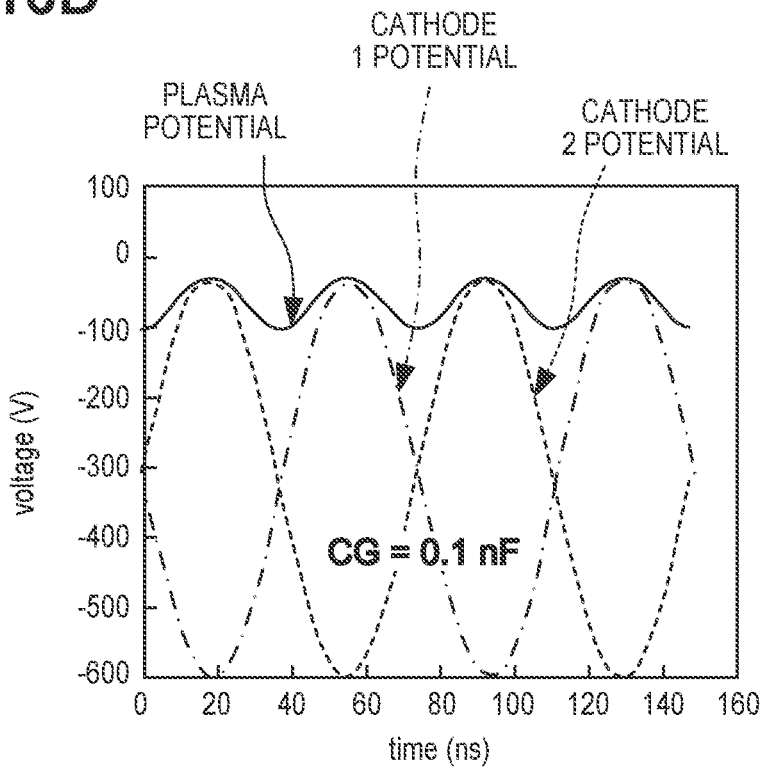
FIG. 16D is a timing chart showing a result of simulating a plasma potential and two cathode potentials when 1.5≤X/Rp≤5000 is not satisfied.

FIGS. 16A to 16D each show a result of simulating the plasma potential, the potential (cathode 1 potential) of the first electrode 105*a*, and the potential (cathode 2 potential) of the second electrode 105*b* when 1.5≤X/Rp≤5000 is not satisfied. FIG. 16A shows the plasma potential, the potential (cathode 1 potential) of the first electrode 105*a*, and the potential (cathode 2 potential) of the second electrode 105*b* in a state in which a resistive film (1 mΩ) is formed on the inner surface of the vacuum container 110. FIG. 16B shows the plasma potential, the potential (cathode 1 potential) of the first electrode 105*a*, and the potential (cathode 2 potential) of the second electrode 105*b* in a state in which a resistive film (1,000Ω) is formed on the inner surface of the vacuum container 110. FIG. 16C shows the plasma potential, the potential (cathode 1 potential) of the first electrode 105*a*, and the potential (cathode 2 potential) of the second electrode 105*b* in a state in which an inductive film (0.6 μH) is formed on the inner surface of the vacuum container 110. FIG. 16D shows the plasma potential, the potential (cathode 1 potential) of the first electrode 105*a*, and the potential (cathode 2 potential) of the second electrode 105*b* in a state in which a capacitive film (0.1 nF) is formed on the inner surface of the vacuum container 110. With reference to FIGS. 16A to 16D, it is understood that when 1.5≤X/Rp≤5000 is not satisfied, the plasma potential changes depending on the state of the inner surface of the vacuum container 110.

In both the case in which X/Rp>5000 (for example, X/Rp=∞) is satisfied and the case in which X/Rp≤1.5 (for example, X/Rp=1.16 or X/Rp=0.87) is satisfied, the plasma potential readily changes depending on the state of the inner surface of the vacuum container 110. If X/Rp>5000 is satisfied, in a state in which no film is formed on the inner surface of the vacuum container 110, discharge occurs only between the first electrode 105*a* and the second electrode 105*b*. However, if X/Rp>5000 is satisfied, when a film starts to be formed on the inner surface of the vacuum container 110, the plasma potential sensitively reacts to this, and the results exemplified in FIGS. 16A to 16D are obtained. On the other hand, when X/Rp<1.5 is satisfied, a current flowing to ground via the vacuum container 110 is large. Therefore, the influence of the state of the inner surface of the vacuum container 110 (the electrical characteristic of a film formed on the inner surface) is conspicuous, and the plasma potential changes depending on formation of a film. Thus, as described above, the sputtering apparatus 1 should be configured to satisfy 1.5≤X/Rp≤5000.

The present invention is not limited to the above-described embodiments, and various changes and modifications can be made within the spirit and scope of the present invention. Therefore, to apprise the public of the scope of the present invention, the following claims are made.

REFERENCE SIGNS LIST

1: plasma processing apparatus, 10: main body, 101: high-frequency power supply, 102: impedance matching circuit, 103: balun, 104: blocking capacitor, 106: first electrode, 107, 108: insulator, 109: target, 110: vacuum container, 111: second electrode, 112: substrate, 201: first unbalanced terminal, 202: second unbalanced terminal, 211: first balanced terminal, 212: second balanced terminal, 251: first terminal, 252: second terminal, 221: first coil, 222: second coil, 223: third coil, 224: fourth coil

The invention claimed is:

1. A plasma processing apparatus comprising:

a balun including a first unbalanced terminal, a second unbalanced terminal, a first balanced terminal, and a second balanced terminal;

a grounded vacuum container;

a first electrode electrically connected to the first balanced terminal;

a second electrode electrically connected to the second balanced terminal, and

−10.0≥dB ISO≥−80 dB is satisfied, wherein ISO equals 20 log(I3/I2'), I2' is a current flowing through the second unbalanced terminal, and I3 is a current flowing from the first balanced terminal to ground.

2. The plasma processing apparatus according to claim 1, wherein the first balanced terminal and the first electrode are electrically connected via a blocking capacitor.

3. The plasma processing apparatus according to claim 1, wherein the second balanced terminal and the second electrode are electrically connected via a blocking capacitor.

4. The plasma processing apparatus according to claim 1, wherein the first balanced terminal and the first electrode are electrically connected via a blocking capacitor, and the second balanced terminal and the second electrode are electrically connected via a blocking capacitor.

5. The plasma processing apparatus according to claim 1, wherein the first electrode is supported by the vacuum container via an insulator.

6. The plasma processing apparatus according to claim 1, wherein an insulator is arranged between the second electrode and the vacuum container.

7. The plasma processing apparatus according to claim 1, further comprising at least one of a mechanism configured to vertically move the second electrode and a mechanism configured to rotate the second electrode.

8. The plasma processing apparatus according to claim 1, wherein the balun includes a first coil configured to connect the first unbalanced terminal and the first balanced terminal, and a second coil configured to connect the second unbalanced terminal and the second balanced terminal.

9. The plasma processing apparatus according to claim 1, wherein the first electrode holds a target, the second electrode holds a substrate, and the plasma processing apparatus is configured as a sputtering apparatus.

10. The plasma processing apparatus according to claim 1, wherein the first electrode holds a substrate, and the plasma processing apparatus is configured as an etching apparatus.

11. The plasma processing apparatus according to claim 1, wherein the first electrode holds a target, and the second electrode is arranged around the first electrode.

12. The plasma processing apparatus according to claim 1, wherein the first electrode holds a substrate, and the second electrode is arranged around the first electrode.

13. The plasma processing apparatus according to claim 1, wherein the first electrode holds a first target, the second electrode holds a second target, the first electrode opposes a space on a side of a substrate as a processing target via the first target, and the second electrode opposes the space via the second target.

14. The plasma processing apparatus according to claim 1, wherein a first high-frequency supply unit and a second high-frequency supply unit are provided, and each of the first high-frequency supply unit and the second high-frequency supply unit includes the balun, the first electrode, and the second electrode, the first electrode of the first high-frequency supply unit holds a target, and the second electrode of the first high-frequency supply unit is arranged around the first electrode of the first high-frequency supply unit, and the first electrode of the second high-frequency supply unit holds a substrate, and the second electrode of the second high-frequency supply unit is arranged around the first electrode of the second high-frequency supply unit.

15. The plasma processing apparatus according to claim 1, wherein a plurality of first high-frequency supply units and a second high-frequency supply unit are provided, and each of the plurality of first high-frequency supply units and the second high-frequency supply unit includes the balun, the first electrode, and the second electrode, the first electrode of each of the plurality of first high-frequency supply units holds a target and, in each of the plurality of first high-frequency supply units, the second electrode is arranged around the first electrode, and the first electrode of the second high-frequency supply unit holds a substrate, and the second electrode of the second high-frequency supply unit is arranged around the first electrode of the second high-frequency supply unit.

16. The plasma processing apparatus according to claim 1, wherein a first high-frequency supply unit and a second high-frequency supply unit are provided, and each of the first high-frequency supply unit and the second high-frequency supply unit includes the balun, the first electrode, and the second electrode, the first electrode of the first high-frequency supply unit holds a first target, the second electrode of the first high-frequency supply unit holds a second target, the first electrode of the first high-frequency supply unit opposes a space on a side of a substrate as a processing target via the first target, and the second electrode of the first high-frequency supply unit opposes the space via the second target, and the first electrode of the second high-frequency supply unit holds the substrate, and the second electrode of the second high-frequency supply unit is arranged around the first electrode of the second high-frequency supply unit.

17. The plasma processing apparatus according to claim 1, further comprising:

a high-frequency power supply; and an impedance matching circuit arranged between the high-frequency power supply and the balun.

18. A plasma processing apparatus comprising:

a balun including a first unbalanced terminal, a second unbalanced terminal, a first balanced terminal, and a second balanced terminal;

a grounded vacuum container;

a first electrode electrically connected to the first balanced terminal; and a second electrode electrically connected to the second balanced terminal, wherein when Rp represents a resistance component between the first balanced terminal and the second balanced terminal when viewing a side of the first electrode and the second electrode from a side of the first balanced terminal and the second balanced terminal, and X represents an inductance between the first unbalanced terminal and the first balanced terminal, $1.5 \leq X/Rp \leq 5000$ is satisfied;

wherein the balun includes a first coil configured to connect the first unbalanced terminal and the first balanced terminal, and a second coil configured to connect the second unbalanced terminal and the second balanced terminal; and wherein the balun further includes a third coil and a fourth coil both of which are connected between the first balanced terminal and the second balanced terminal, and the third coil and the fourth coil are configured to set, as a midpoint between a voltage of the first balanced terminal and a voltage of the second balanced terminal, a voltage of a connection node of the third coil and the fourth coil.

* * * * *